US011780106B2

(12) United States Patent
Schizas et al.

(10) Patent No.: US 11,780,106 B2
(45) Date of Patent: Oct. 10, 2023

(54) BLADE ASSEMBLY WITH LUBRICATING ELEMENTS

(71) Applicant: Bic Violex S.A., Anixi (GR)

(72) Inventors: Charalampos Schizas, Athens (GR); Christos Ampatis, Athens (GR); Dimitrios Efthimiadis, Athens (GR); Ioannis Komianos, Athens (GR); Marina Lymaki, Athens (GR); Athanasia Panou, Athens (GR); Anestis Tsegenidis, Athens (GR); Georgia Tsoukleri, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 102 days.

(21) Appl. No.: 16/634,370

(22) PCT Filed: Jul. 27, 2018

(86) PCT No.: PCT/EP2018/070514
§ 371 (c)(1),
(2) Date: Jan. 27, 2020

(87) PCT Pub. No.: WO2019/020823
PCT Pub. Date: Jan. 31, 2019

(65) Prior Publication Data

US 2021/0094196 A1 Apr. 1, 2021

Related U.S. Application Data

(60) Provisional application No. 62/538,104, filed on Jul. 28, 2017.

(30) Foreign Application Priority Data

Feb. 22, 2018 (EP) ..... 18158015

(51) Int. Cl.
*B26B 21/44* (2006.01)
*B26B 21/56* (2006.01)

(52) U.S. Cl.
CPC ..... *B26B 21/443* (2013.01); *B26B 21/565* (2013.01)

(58) Field of Classification Search
CPC ..... B26B 21/565; B26B 21/443
See application file for complete search history.

(56) References Cited

U.S. PATENT DOCUMENTS 4,291,463 A 9/1981 Williams
5,079,839 A 1/1992 Conrad, Jr. et al.
(Continued)

FOREIGN PATENT DOCUMENTS

CN 1929964 A 3/2007
CN 101516585 A 8/2009
(Continued)

OTHER PUBLICATIONS

International Search Report and Written Opinion issued in related International Application No. PCT/EP2018/070514, dated Oct. 10, 2018 (8 pages).

*Primary Examiner* — Evan H MacFarlane
*Assistant Examiner* — Liang Dong
(74) *Attorney, Agent, or Firm* — Bookoff McAndrews, PLLC

(57) ABSTRACT

A blade assembly including at least one blade support and at least one blade element having a cutting edge portion. The blade support includes a base portion and a flat portion. The flat portion extends at an angle with respect to the base. The at least one blade is attached to the flat portion of the blade support. The blade assembly further includes a lubricating element. The lubricating element is attached to the flat portion and the at least one blade element.

11 Claims, 19 Drawing Sheets

(56) References Cited

U.S. PATENT DOCUMENTS

| | | | | |
|---|---|---|---|---|
| 5,551,153 | A * | 9/1996 | Simms | B26B 21/227 30/41 |
| 7,681,314 | B2 * | 3/2010 | Follo | B26B 21/4012 30/34.2 |
| 9,102,071 | B2 | 8/2015 | Xu | |
| 9,149,944 | B2 | 10/2015 | Hobson, Sr. et al. | |
| 9,789,618 | B2 | 10/2017 | Bozikis et al. | |
| 9,862,108 | B2 | 1/2018 | Davos et al. | |
| 9,925,678 | B2 | 3/2018 | Nicholas | |
| 10,220,532 | B2 | 3/2019 | Davos et al. | |
| 10,220,533 | B2 | 3/2019 | Davos et al. | |
| 10,391,651 | B2 | 8/2019 | Davos et al. | |
| 2012/0000074 | A1 * | 1/2012 | PazosSchroeder | B26B 21/443 30/34.05 |
| 2012/0324737 | A1 * | 12/2012 | Howell | B26B 21/4018 30/50 |
| 2014/0000082 | A1 | 1/2014 | Xu | |
| 2017/0282391 | A1 * | 10/2017 | Provost | B26B 21/44 |
| 2018/0001492 | A1 * | 1/2018 | Nicholas | B41J 3/413 |
| 2018/0001497 | A1 | 1/2018 | Fontecchio et al. | |
| 2019/0193292 | A1 | 6/2019 | Davos et al. | |
| 2019/0344460 | A1 | 11/2019 | Davos et al. | |

FOREIGN PATENT DOCUMENTS

| | | | |
|---|---|---|---|
| CN | 102448685 | A | 5/2012 |
| CN | 103282166 | A | 9/2013 |
| CN | 105518082 | A | 4/2016 |
| JP | 2013099467 | A | 5/2013 |
| WO | WO 2013/050606 | A1 | 4/2013 |
| WO | 2016109136 | A1 | 7/2016 |
| WO | WO 2017/161341 | A1 | 9/2017 |
| WO | 2018007132 | A1 | 1/2018 |

* cited by examiner

BLADE ASSEMBLY WITH LUBRICATING ELEMENTS

CROSS REFERENCE TO RELATED APPLICATION(S)

This application is a National Stage Application of International Application No. PCT/EP2018/070514, filed on Jul. 27, 2018, now published as WO2019020823, which claims the benefit of European Patent Application EP18158015.0, filed on Feb. 22, 2018, and U.S. Provisional Patent Application Ser. No. 62/538,104, filed on Jul. 28, 2017.

BACKGROUND

1. Technical Field

The following description relates to blade assemblies for a shaving device. More particularly, the description relates to incorporated lubricating elements into blade elements of such blade assemblies.

2. Description of Related Technology

Shaving devices, specifically wet shave devices, generally include a head unit having at least one or more cutting members or blades retained therein. The at least one or more cutting members or blades have cutting edges that are aligned in parallel when retained within the head unit. To improve shaving performance, the cutting edges are commonly located very close to one another. The distance between the parallel cutting edges of adjacent cutting members is commonly known as the inter-blade span (IBS). The inter-blade span between cutting edges of the cutting members can control the degree to which skin bulges between the cutting members. A smaller inter-blade span decreases the space for the flow of water and shaving debris through the cutting members (rinsability). A large inter-blade span (IBS) can improve rinsability, but also increases skin bulging between adjacent cutting members, which in circumstances may cause undesirable skin irritation, nicks, and/or cuts. Prior attempts to correct problems associated with decreasing undesirable skin irritations and improved rinsability during shaving include:

1) inter-blade guards that are mounted on the blades and act as skin guards. The inter-blade guards provide a rinse-through gap immediately after the skin-engaging element across the length of the blades to alleviate the constricting spaces between blades. The use of inter-blade guards which act as skin guards assists with rinsability and skin stretching to prevent skin bulging. Also shaving aids are disposed on a portion of the skin-contacting surface of the inter-blade guard providing increased fluidity between the blades and the skin;

2) metallic spacers formed above the surface of the blade, defining a skin engaging cap portion;

3) metallic guard elements deposited on the blade body or over the blade edge;

4) ink objects, printed on the razor blade, which act as skin guards. The ink objects form a continuous strip in a cone-like shape or spaced apart segments extending along the length of the visible surface of the blade. The printed objects can be UV curable inks, polymer-based inks, and can be rigid, multi-flexible, or stretchable; and 5) non-cutting elements disposed anywhere between the guard and the cap, thereby forming rinse-through gaps before and after the non-cutting elements.

SUMMARY

Aspects of the present disclosure provide blade assemblies. A blade assembly comprises at least one blade element including a cutting edge portion, a base portion and a flat portion intermediate to a cutting edge of the cutting edge portion and the base portion. The flat portion extends at an angle with respect to the base. The blade assembly further comprises an incorporated lubricating element, the incorporated lubricating element being attached to the cutting edge portion of the at least one blade element.

According to some embodiments, the flat portion and the base portion may be built together to form a blade support. The cutting edge portion may be mounted on the flat portion of the blade support.

According to some embodiments, the incorporated lubricating element may include a first portion and a second portion.

According to some embodiments, the first portion may be adjacent to the cutting edge portion and the second portion may be adjacent to the blade support.

According to some embodiments, the first portion may be semi-circular and the second portion may be rectangular shaped.

According to some embodiments, the first portion and the second portion may be formed as a single piece.

According to some embodiments, the cutting edge portion may include an upper surface and a lower surface. The blade support may include a front end, wherein the incorporated lubricating element may be attached to the lower surface of the cutting edge portion and the front end of the blade support.

In some embodiments, the cutting edge portion may extend from the cutting edge to an end opposite the cutting edge. The flat portion of the blade support may further include an upper surface and a lower surface. The incorporated lubricating element may be attached to the end of the cutting edge portion and to the upper surface of the flat portion of the blade support.

In some embodiments, the incorporated lubricating element may be quarter circular shaped.

In some embodiments, the cutting edge portion, the base portion and the flat portion may be integrally built as a monoblock to form a bent blade.

In some embodiments, the incorporated lubricating element may be positioned on at least one of an upper surface and a lower surface of the cutting edge portion.

In some embodiments, the blade assembly may further comprise a comb structure attached to a lower surface of the incorporated lubricating element and a lower surface of the flat portion, the comb structure supporting the incorporated lubricating element.

In some embodiments, at least part of the comb structure may be made of a lubricating material.

In some embodiments, the comb structure may have an upper surface attached to the lower surface of the flat portion and may have a lower surface supporting the incorporated lubricating element.

In some embodiments, the incorporated lubricating element may be arranged in a recess formed between the comb structure and the cutting edge portion.

In some embodiments, the cutting edge portion may extend from the cutting edge to an end opposite the cutting edge and the comb structure may extend beyond the cutting edge of the cutting edge portion.

In some embodiments, the cutting edge portion may include at least one aperture therethrough and the incorporated lubricating element may comprise an attachment portion which engages with the at least one aperture.

In some embodiments, the attachment portion may be the second portion.

In some embodiments, the incorporated lubricating element may include a plurality of lubricating spots arranged in at least one row, along a longitudinal direction of the cutting edge portion.

In some embodiments, the cutting edge portion may include a plurality of apertures therethrough. The incorporated lubricating element may comprise a lubricating strip portion and a plurality of attachment portions. The attachment portions may project from a surface of the lubricating strip portion thereby engaging with the plurality of apertures.

In some embodiments, at least one cross-section of the incorporated lubricating element may be mushroom-shaped.

In some embodiments, the first portion may be a mushroom-shaped head and the second portion may be a stem extending from the mushroom-shaped head.

In some embodiments, the cutting edge portion may be angled between 104° to 120° relatively to the base portion.

In some embodiments, the blade assembly may further comprise a plurality of blade elements. At least one of the blade elements may have an incorporated lubricating element attached to the cutting edge portion.

In some embodiments, each blade element of the plurality of the blade elements may be lubricated.

In some embodiments, a head unit may comprise a leading surface and a trailing surface defining a first shaving plane approximately tangent to these leading and trailing surfaces and at least two blade elements forming a blade assembly according to one of the aforementioned blade assemblies. The head unit may comprise at least two incorporated lubricating elements on the at least two blade elements. The incorporated lubricating elements may be attached to the cutting edge portions of the blade elements. The tips of the at least two lubricating elements may define a second shaving plane, wherein an exposure of the cutting edge of the cutting edge portion is negative relatively to the second shaving plane and positive relatively to the first shaving plane or positive to both the first and second shaving planes.

DETAILED DESCRIPTION

Figure 1A:
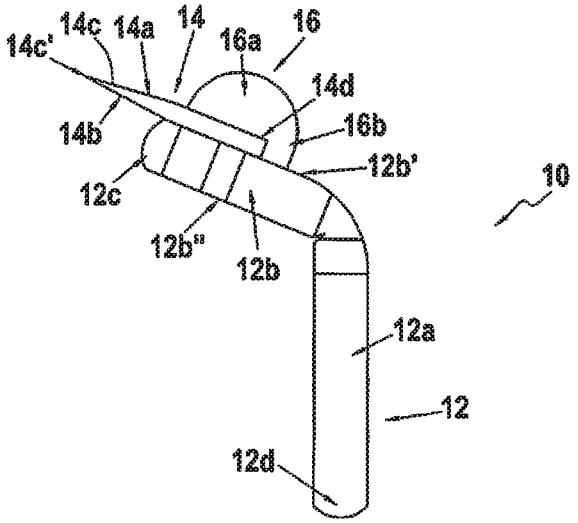
FIG. 1A details a cross-sectional view of an incorporated lubricating element.

Aspects of the present disclosure may include an incorporated lubricating element onto a movable or fixed blade assembly. The incorporated lubricating element may be positioned at various locations on the blade assembly or on a blade element. A blade element may be a blade with a support or a bent blade. For example, when the blade element is a blade with a support, the incorporated lubricating element may be positioned on the blade, after the blade and above the blade support, below the blade support, in front of an extremity of the blade support and below the blade edge on the blade support.

According to other aspects, when the blade element is a bent blade, the incorporated lubricating element may be positioned onto a movable or fixed bent blade. The bent blade may include a cutting edge portion, a base portion and a bent portion intermediate to the cutting edge portion and the base portion, the bent portion being formed integrally with at least the cutting edge portion, and the incorporated lubricating element being attached to the cutting edge portion. The cutting edge portion, the bent portion and the base portion may be integrally formed. The incorporated lubricating element, regardless of the position on the blade assembly, may be capable of managing blade pressure on the skin which may reduce irritation and risk of cuts, may reduce skin bulge thus decreasing frictional resistance between the skin and blades thereby improving fluidity. In some examples, a blade assembly as herein disclosed may comprise a plurality of blade elements, where at least one of the blade elements may have an incorporated lubricating element. In still more examples, each blade element of the plurality of the blade elements may be lubricated.

According to aspects, the incorporated lubricating elements may act as functional spacers (lubra protrusions), therefore, reducing skin being entrapped between the blades. The incorporated lubricating elements may be active elements made of materials or mixtures of materials that reduce friction and/or provide lubrication. Such lubricating element can be comprised by water-soluble and/or water-insoluble components, and/or their combination, and/or soap and soap based mixtures, or pure-polymers able to reduce friction forces. Examples of rigid water insoluble components are polystyrene, styrene co-polymers, polyethylene, polypropylene, polyacetal, acrylonitrile-butadiene-styrene copolymer, ethylene vinyl acetal copolymer, polylactic acid, polycarbonate, maleic anhydride ethylene co-polymer blends, polyether-containing block copolymers (e.g. with polyamide), blends and copolymers of the above with or without other additives. Examples of elastic water insoluble components are thermoplastic elastomer compounds (TPEs), more specifically thermoplastic poly-urethanes, and/or silicone polymers. Typical examples of water soluble lubricating components are polyethylene oxide and/or polyethylene glycol, polyvinyl pyrrolidone, polyacrylamide, polyhydroxymethacrylate, polyvinyl imidazoline, polyvinyl alcohol, polyhydromethymethacrylate, silicone polymers, blends and copolymers of the above.

Figure 13A:
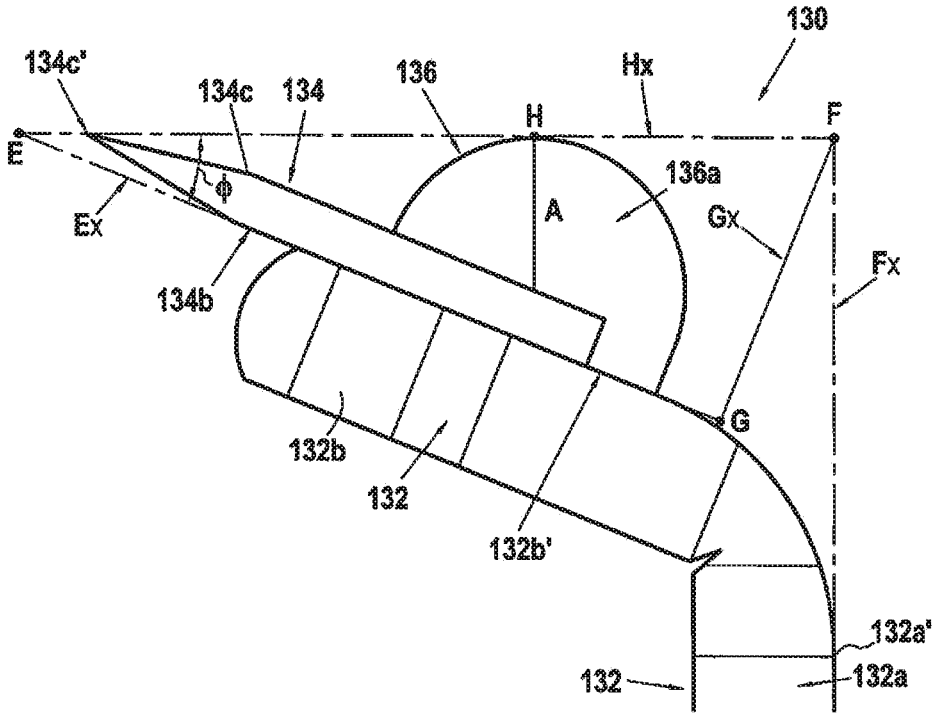
FIG. 13A-13E details various potential locations the incorporated lubricating element may be positioned with respect to the blade and blade support.

According to further aspects, the cross-section of the incorporated lubricating element may be any suitable shape, for example, circular, semi-circular, triangular, rectangular, lemniscate, asymmetrical or any combination thereof; and in particular a shape contained in the triangular head space of the blade as shown by triangle EFG in FIG. 13A. Moreover, the incorporated lubricating elements may have several patterns, such as continuous, non-continuous, curved or any combination thereof. Non-continuous incorporated lubricating elements may have shapes such as spherical, hemispherical, rectangular, orthogonal, pyramidal, ellipsoidal, and any combination thereof.

Figure 1B:
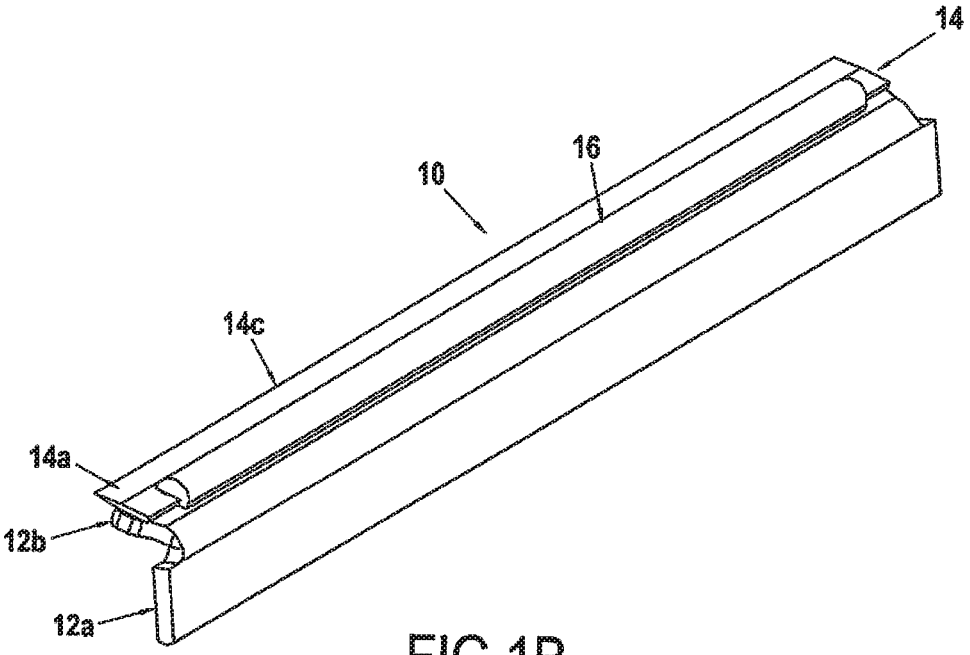
FIG. 1B details a perspective view of the blade and incorporated lubricating element of FIG. 1A.

An aspect of the disclosure, as shown in FIGS. 1A and 1B, may include a blade assembly 10 including a blade support 12 which may have rounded or flat edges, a blade 14 and an incorporated lubricating element 16. The blade 14 may include an upper surface 14*a*, a lower surface 14*b* opposite the upper surface 14*a*, and a cutting edge portion 14*c* extending from a cutting edge 14*c*' to an opposing end 14*d* opposite the cutting edge 14*c*'. The blade may have a thickness between 0.04-0.12 mm. The blade support 12 may include a base portion 12*a* and a flat portion 12*b*. The base portion 12*a* and the flat portion 12*b* may be built together to form a blade support 12. The cutting edge portion 14*c* may be mounted on the flat portion 12*b* of the blade support 12. The base portion 12*a* may have a distal end 12*d* and the flat portion 12*b* may have a front end 12*c*. According to some aspects, the distal end 12*d* and the front end 12*c* may be round or flat. The flat portion 12*b* may extend at an angle with the base portion 12*a*. The angle between the flat portion 12*b* and the base portion 12*a* may be, for example, between 104° to 120°. The flat portion 12*b* may have an upper (outer) surface 12*b*' and a lower (inner) surface 12*b*" opposite the upper (outer) surface 12*b*'. The lower surface 14*b* of the blade 14 may be attached to the outer surface 12*b*' of the blade support 12. The incorporated lubricating element 16 may be disposed on the upper surface 14*a* of the blade 14 of the blade assembly 10 and the outer surface 12*b*' of the blade support 12. The incorporated lubricating element 16 may be attached to the opposing end 14*d* of the cutting edge portion 14*c* and to the outer surface 12*b*' of the flat portion 12*b* of the blade support 12. The incorporated lubricating element 16 may be water soluble and/or water insoluble polymers, and/or mixture of water soluble and water insoluble components. Examples of rigid water insoluble components are polystyrene, styrene co-polymers, polyethylene, polypropylene, polyacetal, acrylonitrile-butadiene-styrene copolymer, ethylene vinyl acetal copolymer, polylactic acid, polycarbonate, maleic anhydride ethylene co-polymer blends, polyether-containing block copolymers (e.g. with polyamide), blends and copolymers of the above with or without other additives. Examples of elastic water insoluble components are thermoplastic elastomer compounds (TPEs), more specifically thermoplastic poly-urethanes, and/or silicone polymers. Typical examples of water soluble lubricating components are polyethylene oxide and/or polyethylene glycol, polyvinyl pyrrolidone, polyacrylamide, polyhydroxymethacrylate, polyvinyl imidazoline, polyvinyl alcohol, polyhydromethymethacrylate, silicone polymers, blends and copolymers of the above. The incorporated lubricating element may be extruded or micro-extruded in a continuous strip line, and further processed to be assembled on the bent blade, or injected, or micro-injected, or 3D printed through material extrusion and/or other 3D manufacturing techniques in individual items to be further assembled on the bent blade. According to some aspects, the lubricating element may consist of 100%-10% of water insoluble component, and/or 90%-0% water soluble component, and/or 15%-0% of other ingredients selected in the group of plasticizers, such as low molecular weight polyethylene glycols, water-swellable release enhancing agents, such as cross-linked polyacrylics and/or maleic anhydride compounds, additional lubricants, compatibilizers, surfactants, and/or skin care agents selected in the group consisting of vitamins, botanical extracts, salts, humectants, fragrances, essential oils, silicon oils, organic oils, waxes, antioxidants, exfoliants, depilatory agents, surfactants, hair and skin conditioning agents, anti-bacterial agents, anti-microbial, anti-irritants, antiseptics, biocides, preservatives, skin cooling and soothing agents, moisturizing and hydrating agents, skin protectants, colorants, film formers, processing thickening agents from the list of silica, fume silica, $TiO_2$ particles, and combinations thereof. The incorporated lubricating element 16 may include a first portion 16*a* and a second portion 16*b*.

The first portion 16*a* may include a semi-circular shape and the second portion 16*b* may include a rectangular leg. While the first portion 16*a* may be detailed as being semi-circular shaped, according to further aspects, the first portion 16*a* may also be a rectangular shape. The first portion 16*a* may be adjacent to the cutting edge portion 14*c* and the second portion 16*b* may be adjacent to the blade support 12.

Figure 2:
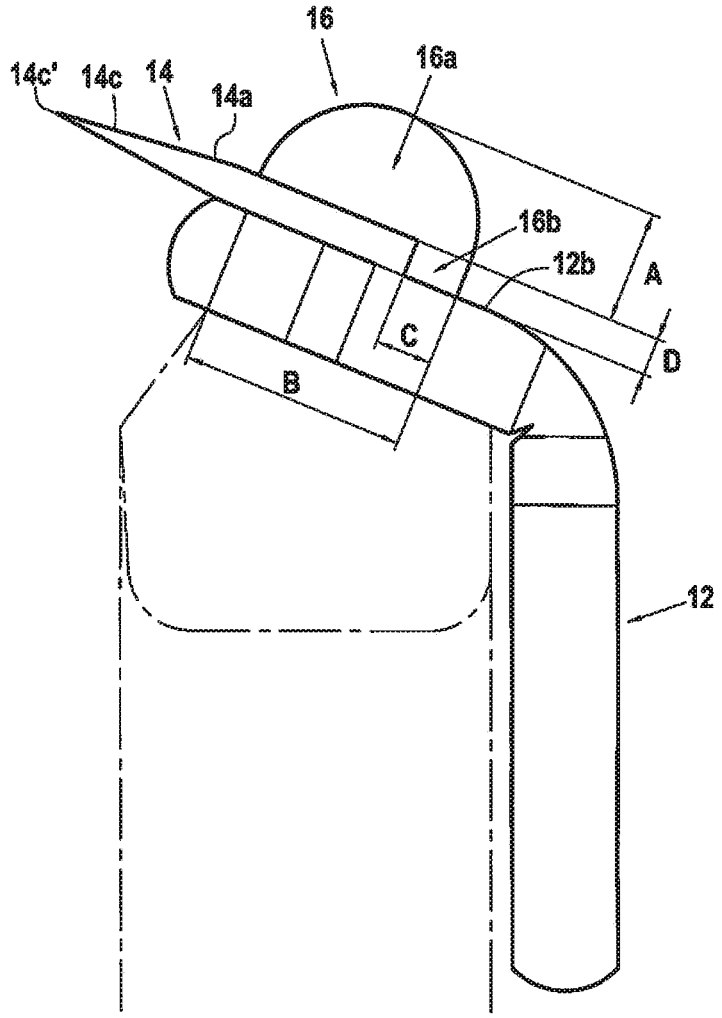
FIG. 2 details a cross-sectional view of a first portion and a second portion of the incorporated lubricating element of FIGS. 1A and 1B.

According to aspects, as shown in FIG. 2, a height A of the first portion 16*a* may be, for example, between 0.01 mm and 0.5 mm, preferably 0.05 mm and 0.5 mm, and a width B of the first portion 16*a* may be, for example, between 0.01 mm and 1.0 mm. A width C of the second portion 16*b* may be, for example, between 0.01 mm and 0.3 mm, preferably 0.05 mm and 0.15 mm, and a height D of the second portion 16*b* may be, for example, between 0.04 mm and 0.25 mm, preferably 0.05 mm to 0.25 mm. According to further aspects, the first portion 16*a* may have a height A, for example, of 0.3 mm and a width B, for example, of 0.6 mm, and the second portion 16*b* may have a width C, for example, of 0.1 mm and a height D, for example, of 0.15 mm. A center of the first portion 16*a* of the incorporated lubricating element 16 may be, for example, about 0.3 to 1.4 mm, preferably 0.75 to 1.3 mm from the cutting edge 14*c*' of the blade 14. As such, the first portion 16*a* may be disposed on the upper surface 14*a* of the blade 14 while the second portion 16*b* may be simultaneously disposed on the outer surface 12*b*' of the blade support 12. During manufacture, the second portion 16*b* of the incorporated lubricating element 16 may assist with alignment and attachment of the incorporated lubricating element 16 to the blade support 12. The first portion 16*a* and the second portion 16*b* may be extruded or injected as a single piece, as shown in FIG. 1A. According to some aspects, the second portion 16*b* may be adjacent to a back side (a side furthest from the cutting edge 14*c*' of the blade 14) of the first portion 16*a*. According to further aspects, the second portion 16*b* may also be attached to the first portion 16*a*, such as for example, by adhesion and/or any other similar technique.

Figure 3A:
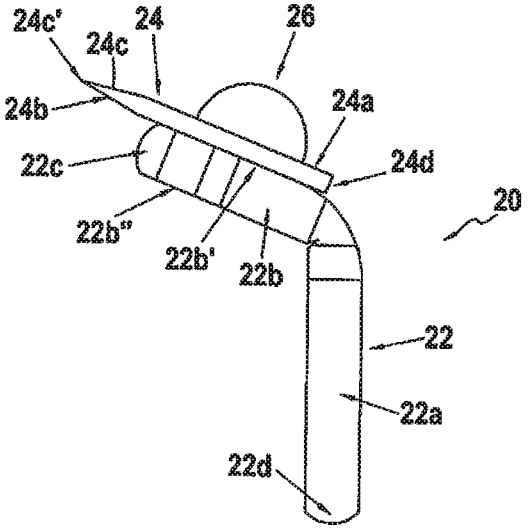
FIG. 3A details a cross-sectional view of another aspect of the incorporated lubricating element.
Figure 3B:
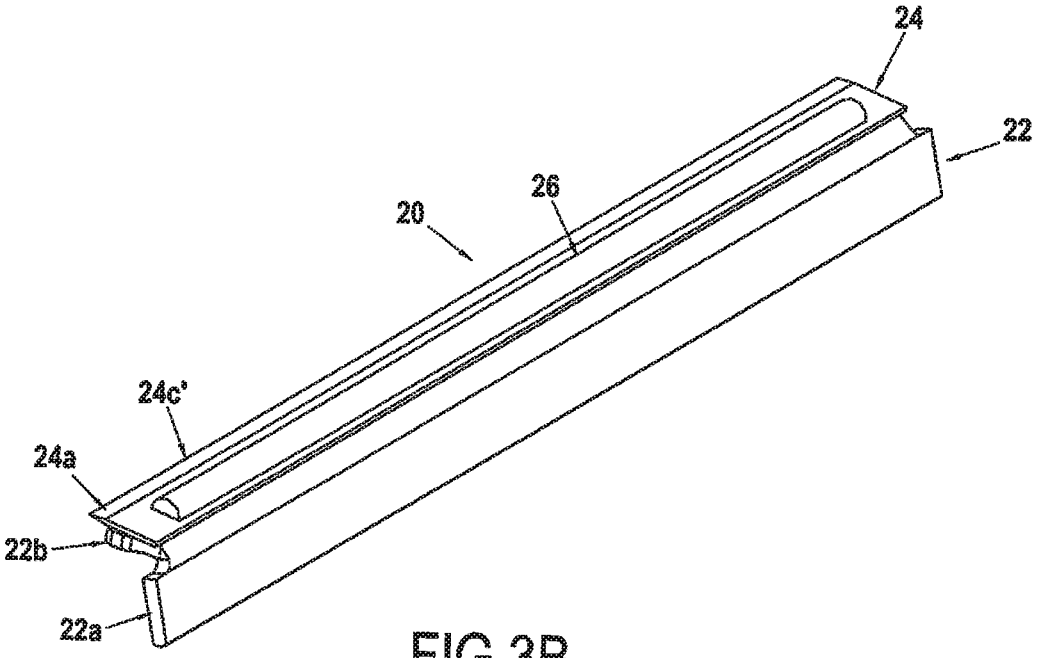
FIG. 3B a perspective view of the incorporated lubricating element of FIG. 3A.

According to further aspects, as shown in FIGS. 3A and 3B a blade assembly 20 may include a blade support 22, a blade 24 and an incorporated lubricating element 26. The blade 24 may include an upper surface 24*a*, a lower surface 24*b* opposite the upper surface 24*a*, and a cutting edge portion 24*c* extending from a cutting edge 24*c*' to an opposing end 24*d* opposite the cutting edge 24*c*'. The blade support 22 may include a base portion 22*a* and a flat portion 22*b*. The base portion 22*a* and the flat portion 22*b* may be built together to form a blade support 22. The cutting edge portion 24*c* may be mounted on the flat portion 22*b* of the blade support 22. The base portion 22*a* may have a distal end 22*d* and the flat portion 22*b* may have a front end 22*c*. According to some aspects, the distal end 22*d* and front end 22*c* may be round or flat. The flat portion 22*b* may extend at an angle with the base portion 22*a*, such as for example, between 104° to 120°. The flat portion 22*b* may have an upper (outer) surface 22*b*' and a lower (inner) surface 22*b*" opposite the upper (outer) surface 22*b*'. The lower surface 24*b* of the blade 24 may be attached to the outer surface 22*b*' of the blade support 22. The incorporated lubricating element 26 may be disposed on the upper surface 24*a* of the blade 24 of the blade assembly 20. The incorporated lubricating element 26 may be an extruded continuous strip or injected and/or 3D printed individual items and may be semi-circular in shape. Although a semi-circular shape is detailed, according to further aspects, the incorporated lubricating element 26 may also be rectangular or any other suitable shape.

Figure 3C:
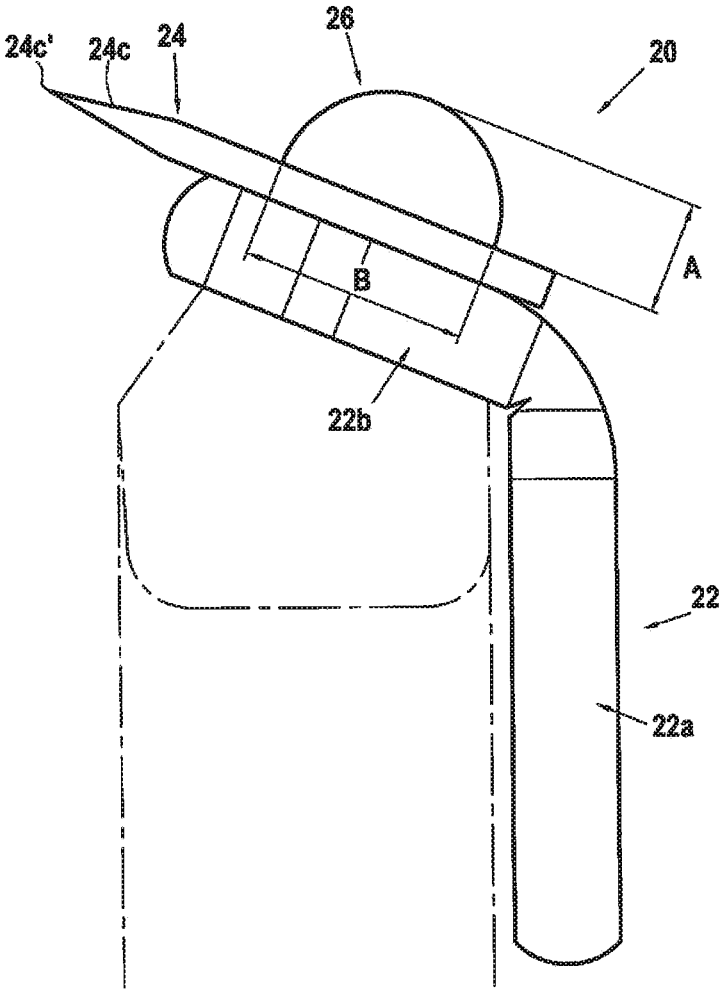
FIG. 3C details a cross-sectional view of the incorporated lubricating element of FIGS. 3A and 3B.

As shown in FIG. 3C, a general, height A and width B of the incorporated lubricating element is detailed for all aspects. However, according to aspects of the incorporated lubricating element 26 of FIGS. 3A and 3B, the height A of the incorporated lubricating element 26 may be, for example, between 0.01 mm and 0.5 mm, preferably 0.05 mm and 0.5 mm, and the width B may be, for example, between 0.01 mm and 1.0 mm. The incorporated lubricating element 26 may be positioned, for example, 0.3 mm to 1.4 mm, preferably 0.5 mm to 1.2 mm from the cutting edge 24*c*' of the blade 24.

Figure 4A:
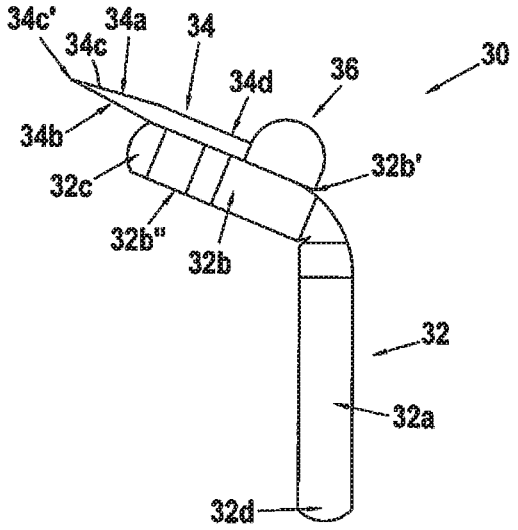
FIG. 4A a cross-sectional view of another aspect of the incorporated lubricating element.
Figure 4B:
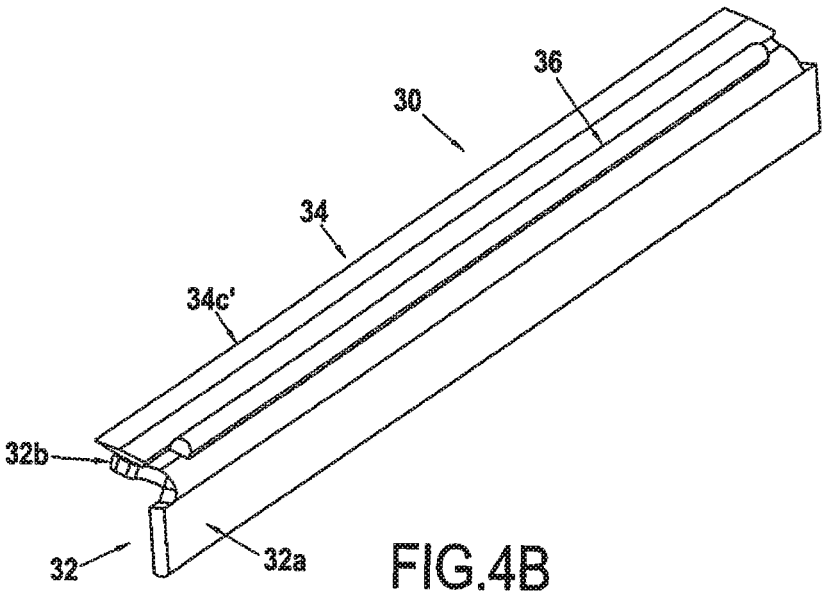
FIG. 4B details a perspective view of the incorporated lubricating element of FIG. 4A.

According to further aspects, as shown in FIGS. 4A and 4B, a blade assembly 30 may include a blade support 32, a blade 34 and an incorporated lubricating element 36. The blade 34 may include an upper surface 34*a*, a lower surface 34*b* opposite the upper surface 34*a*, and a cutting edge portion 34*c* extending from a cutting edge 34*c*' to an opposing end 34*d* opposite the cutting edge 34*c*'. The blade support 32 may include a base portion 32*a* and a flat portion 32*b*. The base portion 32*a* and the flat portion 32*b* may be built together to form a blade support 32. The cutting edge portion 34*c* may be mounted on the flat portion 32*b* of the blade support 32. The base portion 32*a* may have a distal end 32*d* and the flat portion 32*b* may have a front end 32*c*. According to some aspects, the distal end 32*d* and front end 32*c* may be round or flat. The flat portion 32*b* may extend at an angle with the base portion 32*a*, such as for example, between 104° to 120°. The flat portion 32*b* may have an upper (outer) surface 32*b*' and a lower (inner) surface 32*b*" opposite the upper (outer) surface 32*b*'. The lower surface 34*b* of the blade 34 may be attached to the outer surface 32*b*' of the blade support 32. The incorporated lubricating element 36 may be disposed after the blade 34 at the opposing end 34*d* and on the outer surface 32*b*' of the flat portion 32*b* of the blade support 32. The incorporated lubricating element 36 may be an extruded continuous strip or injected and/or 3D printed individual items and may be semi-circular in shape. According to further aspects, the incorporated lubricating element 36 may also be rectangular or any other suitable shape. The incorporated lubricating element 36 may have a height A, for example, of between 0.01 mm and 0.5 mm, preferably 0.1 mm and 0.5 mm and a width B, for example, of between 0.01 mm and 1.0 mm, preferably 0.2 mm and 1.0 mm.

Figure 5A:
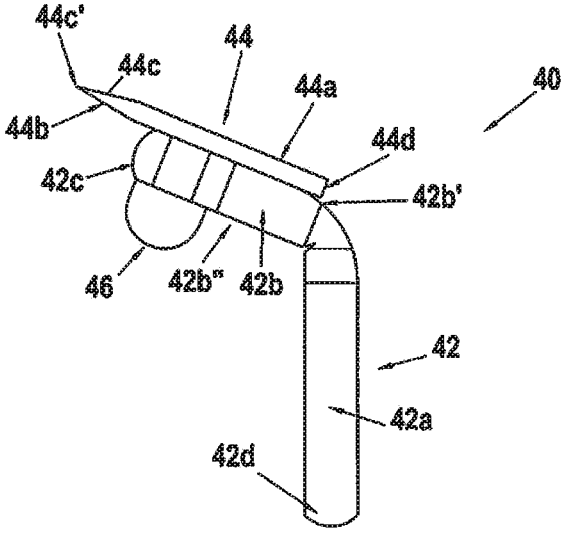
FIG. 5A details a cross-sectional view of another aspect of the incorporated lubricating element.
Figure 5B:
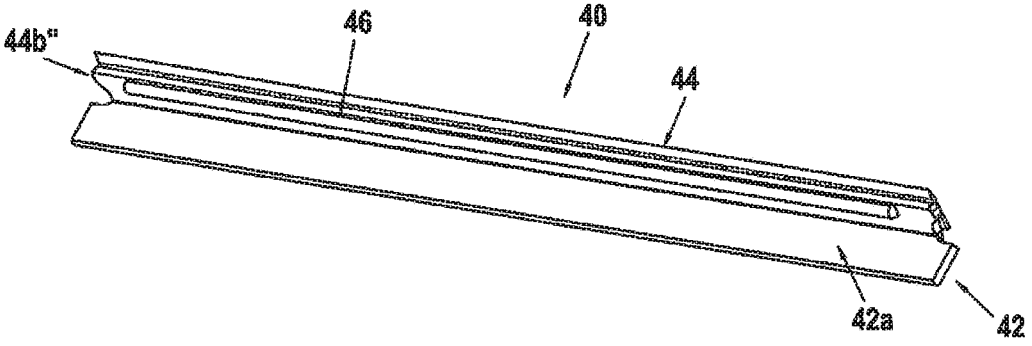
FIG. 5B details a perspective view of the incorporated lubricating element of FIG. 5A.

According to further aspects, as shown in FIGS. 5A and 5B, a blade assembly 40 may include a blade support 42, a blade 44 and an incorporated lubricating element 46. The blade 44 may include an upper surface 44*a*, a lower surface 44*b* opposite the upper surface 44*a*, and a cutting edge portion 44*c* extending from a cutting edge 44*c*' to an opposing end 44*d* opposite the cutting edge 44*c*'. The blade support 42 may include a base portion 42*a* and a flat portion 42*b*. The base portion 42*a* and the flat portion 42*b* may be built together to form a blade support 42. The cutting edge portion 44*c* may be mounted on the flat portion 42*b* of the blade support 42. The base portion 42*a* may have a distal end 42*d* and the flat portion 42*b* may have a front end 42*c*. According to some aspects, the distal end 42*d* and front end 42*c* may be round or flat. The flat portion 42*b* may extend at an angle with the base portion 42*a*, such as for example, between 104° to 120°. The flat portion 42*b* may have an upper (outer) surface 42*b*' and a lower (inner) surface 42*b*" opposite the upper (outer) surface 42*b*'. The lower surface 44*b* of the blade 44 may be attached to the outer surface 42*b*' of the blade support 42. The incorporated lubricating element 46 may be disposed on the lower (inner) surface 42*b*" of the flat portion 42*b* of the blade support 42. The incorporated lubricating element 46 may be an extruded continuous strip or injected and/or 3D printed individual items and may be semi-circular in shape. According to further aspects, the incorporated lubricating element 46 may also be rectangular or any suitable shape. The center of the lubricating element 46 may be, for example, about 0.3 to 1.4 mm, preferably 0.75 to 0.95 mm from the blade portion 42*a* of the blade support 42. The incorporated lubricating element 46 may be have a height A, for example, between 0.01 mm and 0.5 mm, preferably 0.1 mm and 0.5 mm and a width B, for example, between 0.02 mm and 1 mm, preferably 0.2 mm and 1.0 mm.

Figure 6A:
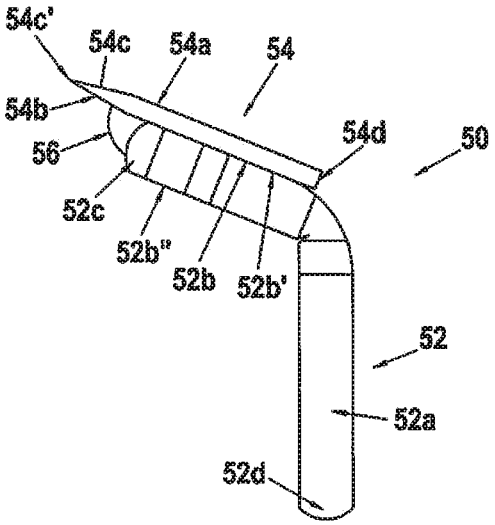
FIG. 6A details a cross-sectional view of another aspect of the incorporated lubricating element.
Figure 6B:
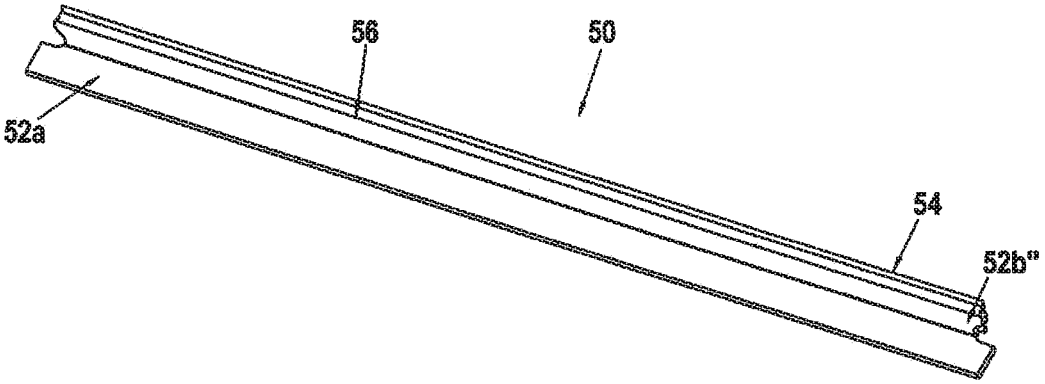
FIG. 6B details a perspective view of the incorporated lubricating element of FIG. 6A.

According to further aspects, as shown in FIGS. 6A and 6B, a blade assembly 50 may include a blade support 52, a blade 54 and an incorporated lubricating element 56. The blade 54 may include an upper surface 54*a*, a lower surface 54*b* opposite the upper surface 54*a*, and a cutting edge portion 54*c* extending from a cutting edge 54*c*' to an opposing end 54*d* opposite the cutting edge 54*c*'. The cutting edge portion 54*c* may share the upper surface 54*a* and the lower surface 54*b* of the blade 54. The blade support 52 may include a base portion 52*a* and a flat portion 52*b*. The base portion 52*a* and the flat portion 52*b* may be built together to form a blade support 52. The cutting edge portion 54*c* may be mounted on the flat portion 52*b* of the blade support 52. The flat portion 52*b* may extend at an angle with the base portion 52*a*, such as for example, between 104° to 120°. The flat portion 52*b* may have an upper (outer) surface 52*b*' and a lower (inner) surface 52*b*" opposite the upper (outer) surface 52*b*'. The lower surface 54*b* of the blade 54 may be attached to the outer surface 52*b*' of the blade support 52. The incorporated lubricating element 56 may be disposed on the lower surface 54*b* at a front end 52*c* of the flat portion 52*b* of the blade 54 and of the blade support 52. In other words, the incorporated lubricating element 56 may be attached to the lower surface 54*b* of the blade 54 (and/or the cutting edge portion 54*c*) and the front end 52*c* of the blade support 52. The base portion 52*a* may have a distal end 52*d*. According to some aspects, the front end 52*c* and the distal end 52*d* may be round or flat. The incorporated lubricating element 56 may be an extruded continuous strip or injected and/or 3D printed individual items and may be quarter-circular in shape and may conform to the front end 52*c* of the flat portion 52*b* of the blade support 52. According to further aspects, the incorporated lubricating element 56 may also be a rectangular or any other suitable shape. The incorporated lubricating element 56 may be have a height A, for example, of between 0.05 mm and 0.5 mm, preferably 0.12 mm and 0.32 mm and a width B, for example, of between 0.05 mm and 0.5 mm, preferably 0.13 mm and 0.27 mm.

Figure 7A:
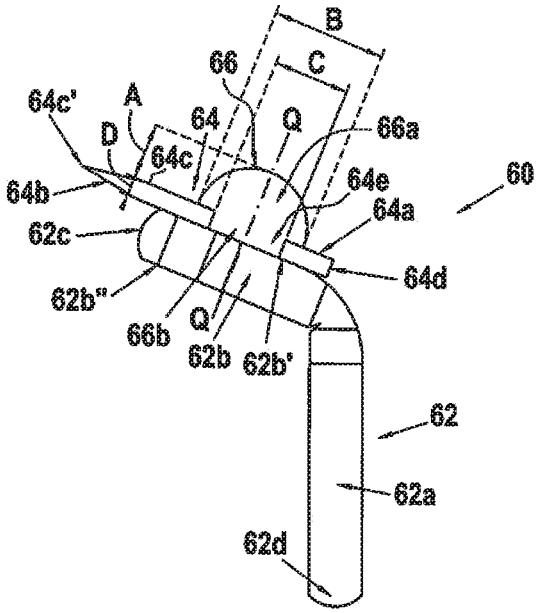
FIG. 7A details a cross-sectional view of another aspect of the incorporated lubricating element.
Figure 7B:
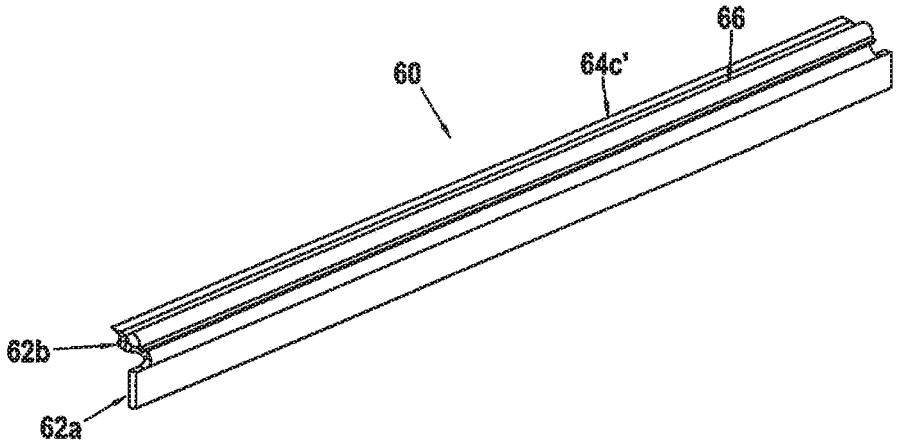
FIG. 7B details a perspective view of the incorporated lubricating element of FIG. 7A.

According to further aspects, as shown in FIGS. 7A and 7B, a blade assembly 60 may include a blade support 62, a blade 64 and an incorporated lubricating element 66. The blade 64 may include an upper surface 64*a*, a lower surface 64*b* opposite the upper surface 64*a*, and a cutting edge portion 64*c* extending from a cutting edge 64*c*' to an opposing end 64*d* opposite the cutting edge 64*c*'. The blade 64 (and/or the cutting edge portion 64*c*) may also include apertures 64*e* therethrough which may be spaced equidistantly there along (not shown). The blade support 62 may include a base portion 62*a* and a flat portion 62*b*. The base portion 62*a* and the flat portion 62*b* may be built together to form a blade support 62. The cutting edge portion 64*c* may be mounted on the flat portion 62*b* of the blade support 62. The base portion 62*a* may have a distal end 62*d* and the flat portion 62*b* may have a front end 62*c*. According to some aspects, the distal end 62*d* and front end 62*c* may be round or flat. The flat portion 62*b* may extend at an angle with the base portion 62*a*, such as for example, of between 104° to 120°. The flat portion 62*b* may have an upper (outer) surface 62*b*' and a lower (inner) surface 62*b*" opposite the upper (outer) surface 62*b*'. The lower surface 64*b* of the blade 64 may be attached to the outer surface 62*b*' of the blade support 62. The incorporated lubricating element 66 may include a first portion 66*a* and a second portion 66*b*. The first portion 66*a* may be semi-circular shaped and the second portion 66*b* may be rectangular shaped. The first portion 66*a* and the second portion 66*b*, together, may form a mushroom-shaped incorporated lubricating element 66. For example, the first portion 66*a* and the second portion 66*b* may have a center axis "Q", where the maximum radial distance of the second portion relative to the center axis Q is smaller than the maximum radial distance of the first portion relative to the center axis Q. While the first portion 66*a* may be detailed as being semi-circular shaped, according to further aspects, the first portion 66*a* may also be a rectangular shape. According to other aspects, the first portion 66*a* may be rectangular or any other suitable shape. In some examples, the first portion 66*a* may be a mushroom-shaped head and the second portion 66*b* may be a stem extending from the mushroom-shaped head. The first portion 66*a* may be adjacent to the cutting edge portion 64*c* and the second portion 66*b* may be adjacent to the blade support 62. The second portion 66*b* of the incorporated lubricating element 66 may extend through the apertures 64*e* formed in the blade 64 (and/or the cutting edge portion 64*c*) such that the second portion 66*b* may be disposed on the outer surface 62*b*' of the blade support 62 and the first portion 66*a* may be disposed on the upper surface 64*a* of the blade 64 of the blade assembly 60. The incorporated lubricating element 66 may comprise the second portion 66*b* as attachment portion, which engages with the at least one aperture 64*e*. In some examples, the incorporated lubricating element 66 may comprise a lubricating strip portion and a plurality of attachment portions, where the attachment portions project from a surface of the lubricating strip portion thereby engaging with a plurality of apertures 64*e*. The incorporated lubricating element 66 may be an extruded continuous strip or injected and/or 3D printed individual items. The first portion 66*a* of the incorporated lubricating element 66 may be have a height A, for example, of between 0.01 mm and 0.5 mm, preferably 0.17 mm and 0.5 mm and a width B, for example, of between 0.01 mm and 1.0 mm. The second portion 66*b* of the incorporated lubricating element 66 may be have a width C and a height D, for example, of between 0.01 mm and 1.0 mm, preferably 0.1 and 1.0 mm and 0.04 mm and 0.25 mm, preferably 0.05 mm and 0.1 mm, respectively. The second portion 66*b* may be formed or positioned at a center or centroid of the width B of the first portion 66*a*. According to some aspects, instead of being extruded or injected, the first portion 66*a* and the second portion 66*b* may be formed separately, as individual pieces, wherein the second portion 66*b* may be attached to the first portion 66*a*, such as for example, by adhesion and/or any other similar technique.

Figure 8A:
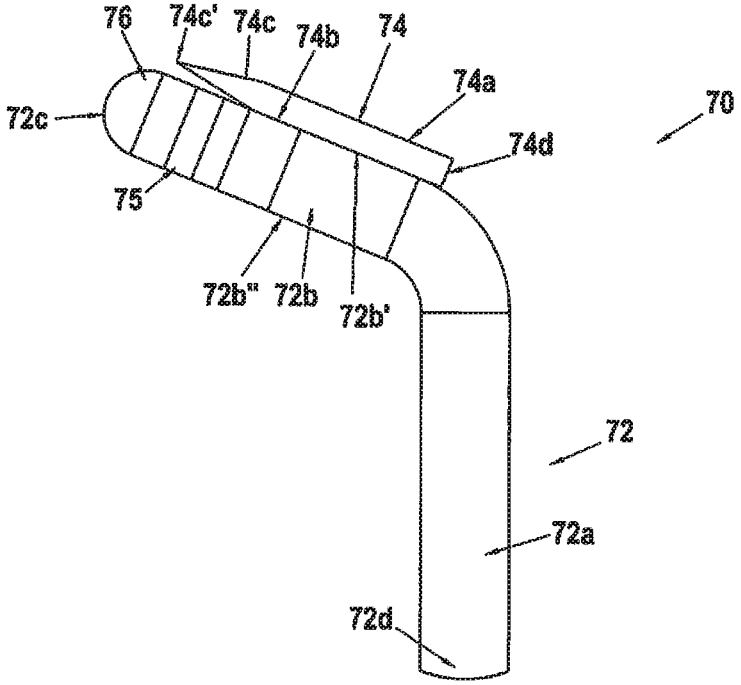
FIG. 8A details a cross-sectional view of another aspect of the incorporated lubricating element.
Figure 8B:
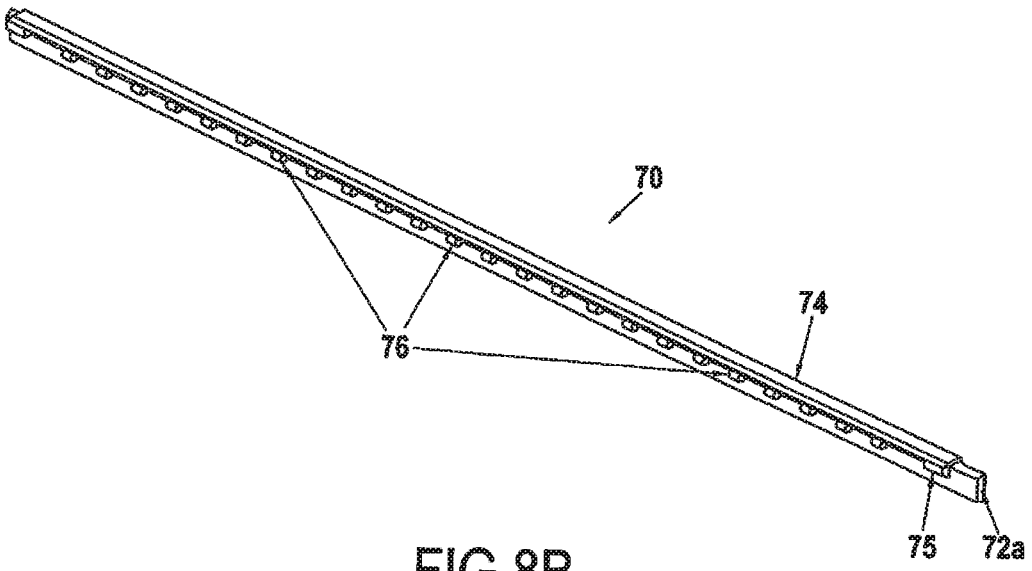
FIG. 8B details a perspective view of the incorporated lubricating element of FIG. 8A.

According to further aspects, as shown in FIGS. 8A and 8B, a blade assembly 70 may include a blade support 72, a blade 74 and an incorporated lubricating element 76. The blade 74 may include an upper surface 74*a*, a lower surface 74*b* opposite the upper surface 74*a*, and a cutting edge portion 74*c* extending from a cutting edge 74*c*' to an opposing end 74*d* opposite the cutting edge 74*c*'. The blade 74 may further include a comb support 75. The blade 74 may be attached to the comb support 75 such that the comb support 75 may project/extend beyond the cutting edge 74*c*' of the blade 74. The comb support 75 may include incorporated lubricating elements in the form of teeth. The incorporated lubricating teeth elements 76 may be extruded or injected or 3D printed. The blade support 72 may include a base portion 72*a* and a flat portion 72*b*. The base portion 72*a* and the flat portion 72*b* may be built together to form a blade support 72. The cutting edge portion 74*c* may be mounted on the flat portion 72*b* of the blade support 72. The flat portion 72*b* may extend at an angle with the base portion 72*a*, such as for example, of between 104° to 120°. The flat portion 72*b* may have an upper (outer) surface 72*b*', a lower (inner) surface 72*b*" opposite the upper (outer) surface 72*b*', and a front end 72*c*. The lower surface 74*b* of the blade 74 may be attached to the outer surface 72*b*' of the blade support 72 such that the comb support 75 may be disposed adjacent to the front end 72*c* of the flat portion 72*b* of the blade support 72. As such, the incorporated lubricating teeth elements 76 may project beyond the cutting edge 74*c*' of the blade 74. The incorporated lubricating teeth elements 76 may be semi-circular in shape and may be spaced equidistantly along the comb support 75. According to further aspects, the incorporated lubricating teeth elements 76 may also be rectangular or any other suitable shape. While twenty-four teeth may be disclosed, any number of teeth may also be feasible. The incorporated lubricating teeth element 76 may be have a height A, for example, of between 0.05 mm and 1.0 mm, preferably 0.12 mm and 0.32 mm and a width B, for example, of between 0.05 mm and 1.0 mm, preferably 0.3 mm and 0.7 mm. The distance between two adjacent teeth may be, for example, between 0.05 mm and 37.1 mm, preferably 0.5 mm and 4.0 mm.

Figure 9A:
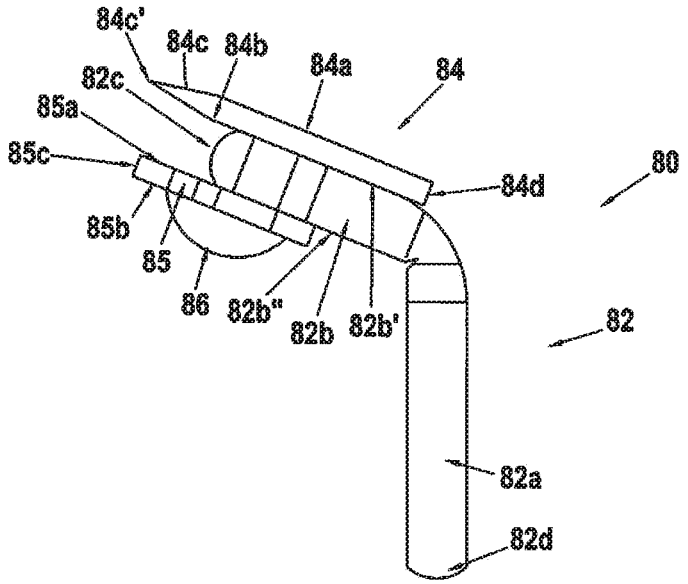
FIG. 9A details a cross-sectional view of another aspect of the incorporated lubricating element.
Figure 9B:
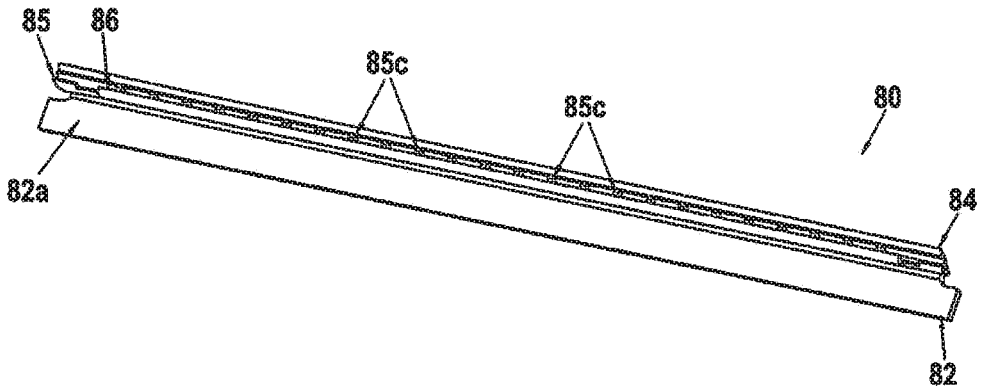
FIG. 9B details a perspective view of the incorporated lubricating element of FIG. 9A.

According to further aspects, as shown in FIGS. 9A and 9B, a blade assembly 80 may include a blade support 82, a blade 84, a comb structure 85 and an incorporated lubricating element 86. The blade 84 may include an upper surface 84*a*, a lower surface 84*b* opposite the upper surface 84*a* and, a cutting edge portion 84*c* extending from a cutting edge 84*c*' to an opposing end 84*d* opposite the cutting edge 84*c*'. The blade support 82 may include a base portion 82*a* and a flat portion 82*b*. The base portion 82*a* and the flat portion 82*b* may be built together to form a blade support 82. The cutting edge portion 84*c* may be mounted on the flat portion 82*b* of the blade support 82. The flat portion 82*b* may extend at an angle to the base portion 82*a*, such as for example, of between 104° to 120°. The flat portion 82*b* may have an upper (outer) surface 82*b*', a lower (inner) surface 82*b*" opposite the outer surface 82*b*', and a front end 82*c*. The base portion 82*a* may have a distal end 82*d*. According to some aspects, the front end 82*c* and the distal end 82*d* may be round or flat. The comb structure 85 may have an upper surface 85*a* and a lower surface 85*b* opposite the upper surface 85*a*. The comb structure 85 may include teeth 85*c*. According to further aspects, the teeth 85*c* may be round, rectangular or any suitable shape. The teeth 85*c* may project a distance beyond the cutting edge 84*c*' of the blade 84 For example, the distance that the teeth 85*c* may project beyond the cutting edge 84*c*' may be between 0.1 mm to 0.5 mm. The distance between two adjacent teeth 85*c* may be between 0.5 mm and 4.0 mm. While twenty-four teeth may be disclosed, any number of teeth may also be used. The lower surface 84*b* of the blade 84 may be attached to the outer surface 82*b*' of the blade support 82 and the upper surface 85*a* of the comb structure 85 may be disposed adjacent to the lower (inner) surface 82*b*" of the flat portion 82*b* of the blade support 82. The incorporated lubricating element 86 may be a continuous extruded strip or injected and/or 3D printed individual items and may be semi-circular in shape. According to further aspects, the incorporated lubricating element 86 may also be rectangular or any suitable shape. The incorporated lubricating element 86 may be disposed adjacent to the lower surface 85*b* of the comb structure 85. In some examples, the comb structure may be attached to a lower surface of the incorporated lubricating element 86 and the lower (inner) surface 82*b*" of the flat portion 82*b*, such that the comb structure supports the incorporated lubricating element 86. The incorporated lubricating element 86 may be have a height A, for example, of between 0.05 mm and 0.5 mm, preferably 0.1 mm and 0.3 mm and a width B, for example, of between 0.1 mm and 1.0 mm, preferably 0.2 mm to 0.8 mm.

Figure 10A:
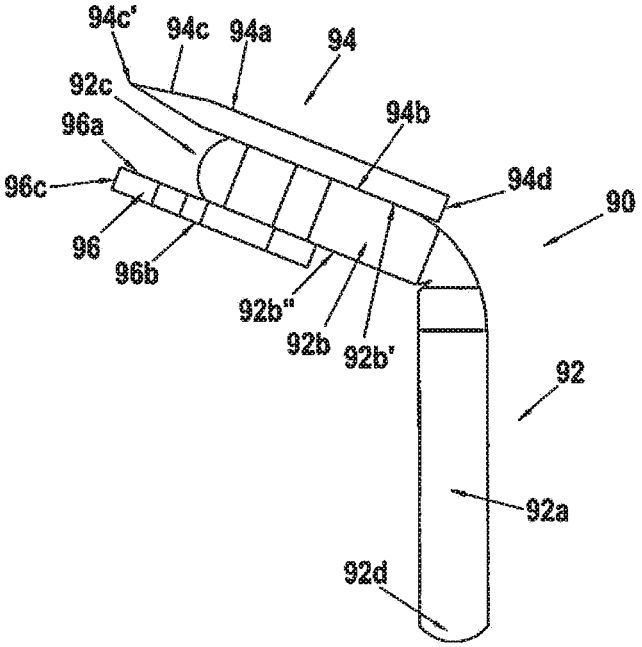
FIG. 10A details a cross-sectional view of another aspect of the incorporated lubricating element.
Figure 10B:
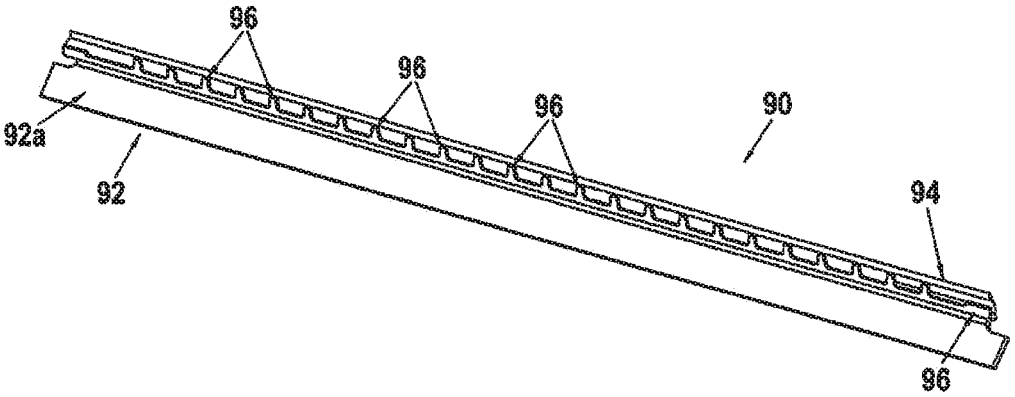
FIG. 10B details a perspective view of the incorporated lubricating element of FIG. 10A.

According to further aspects, as shown in FIGS. 10A and 10B, a blade assembly 90 may include a blade support 92, a blade 94 and an incorporated lubricating element 96. The blade 94 may include an upper surface 94*a*, a lower surface 94*b* opposite the upper surface 94*a*, and a cutting edge portion 94*c* extending from a cutting edge 94*c*' to an opposing end 94*d* opposite the cutting edge 94*c*'. The incorporated lubricating element may be a comb 96. The incorporated lubricating comb element 96 may include an upper surface 96*a* and a lower surface 96*b* opposite the upper surface 96*a*. The incorporated lubricating comb element 96 may include teeth 96*c*. According to further aspects, the teeth 96*c* may also be round, rectangular, or any suitable shape. The incorporated lubricating comb element 96 may be extruded or injected. The blade support 92 may include a base portion 92*a* and a flat portion 92*b*. The base portion 92*a* and the flat portion 92*b* may be built together to form a blade support 92. The cutting edge portion 94*c* may be mounted on the flat portion 92*b* of the blade support 92. The base portion 92*a* may have a distal end 92*d* and the flat portion 92*b* may have a front end 92*c*. According to some aspects, the distal end 92*d* and front end 92*c* may be round or flat. The flat portion 92*b* may extend at an angle to the base portion 92*a*, such as for example, of between 104° to 120°. The flat portion 92*b* may have an upper (outer) surface 92*b*' and a lower (inner) surface 92*b*" opposite the upper (outer) surface 92*b*'. The lower surface 94*b* of the blade 94 may be attached to the outer surface 92*b*' of the blade support 92 and the upper surface 96*a* of the incorporated lubricating comb element 96 may be disposed adjacent to the lower (inner) surface 92*b*" of the flat portion 92*b* of the blade support 92. The incorporated lubricating comb element 96 may be positioned such that the teeth 96*c* may project beyond the front end 92*c* of the blade support 92. The teeth 96*c* may also project beyond the cutting edge 94*c*' of the blade 94 at a distance. The distance that the teeth 96*c* may project beyond the cutting edge 94*c*' may be, for example, between 0.05 mm and 1.0 mm, preferably 0.1 mm to 0.5 mm. The teeth 96*c* may be spaced equidistantly along the incorporated lubricating comb element 96. A distance between the centers of two adjacent teeth 96*c* may be, for example, between 0.05 mm and 37.1 mm, preferably 0.5 mm and 4.0 mm. While twenty-four teeth may be disclosed, any number of teeth may also be feasible. The incorporated lubricating comb element 96 may be have a height A, for example, of between 0.05 mm and 0.5 mm, preferably 0.2 mm and 0.3 mm and a width B, for example, of between 0.1 mm and 2.0 mm, preferably 1.3 mm and 1.85 mm.

Figure 11A:
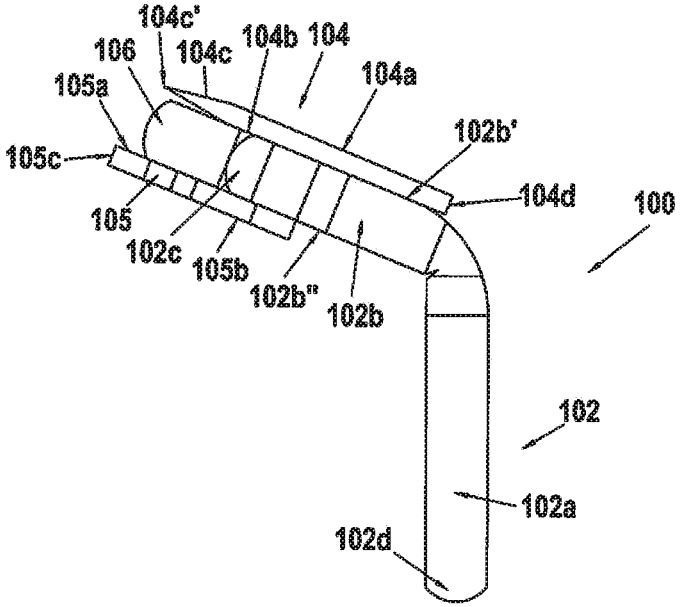
FIG. 11A details a cross-sectional view of another aspect of the incorporated lubricating element.
Figure 11B:
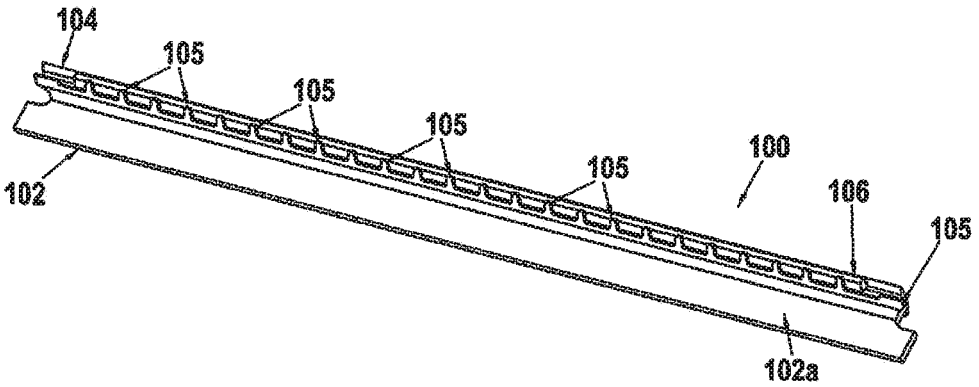
FIG. 11B details a perspective view of the incorporated lubricating element of FIG. 11A.

According to further aspects, as shown in FIGS. 11A and 11B, a blade assembly 100 may include a blade support 102, a blade 104, a comb structure 105 and an incorporated lubricating element 106. The blade 104 may include an upper surface 104*a*, a lower surface 104*b* opposite the upper surface 104*a*, and a cutting edge portion 104*c* extending from a cutting edge 104*c*' to an opposing end 104*d* opposite the cutting edge 104*c*'. The blade support 102 may include a base portion 102*a* and a flat portion 102*b*. The base portion 102*a* and the flat portion 102*b* may be built together to form a blade support 102. The cutting edge portion 104*c* may be mounted on the flat portion 102*b* of the blade support 102. The flat portion 102*b* may extend at an angle with the base portion 102*a*, such as for example, of between 104° to 120°. The base portion 102*a* may have a distal end 102*d* and the flat portion 102*b* may have a front end 102*c*. According to some aspects, the distal end 102*d* and front end 102*c* may be round or flat. The flat portion 102*b* may have an upper (outer) surface 102*b*' and a lower (inner) surface 102*b*" opposite the outer surface 102*b*'. The comb structure 105 may have an upper surface 105*a* and a lower surface 105*b* opposite the upper surface 105*a*. The lower surface 104*b* of the blade 104 may be attached to the outer surface 102*b*' of the blade support 102 and the upper surface 105*a* of the comb structure 105 may be disposed adjacent to the lower (inner) surface 102*b*" of the flat portion 102*b* of the blade support 102. The comb structure 105 may include teeth 105*c*. According to further aspects, the teeth 105*c* may also be round, rectangular, or any suitable shape. The comb structure 105 may be positioned with respect to the blade support 102 such that the teeth 105*c* of the comb structure 105 may project a distance beyond the front end 102*c* of the flat portion 102*b* of the blade support 102. The teeth 105*c* may also project a distance beyond the cutting edge 104*c*' of the blade 104. The distance that the teeth 105*c* may project beyond the cutting edge 104*c*' may be, for example, between 0.05 mm and 1.0 mm, preferably 0.1 mm to 0.5 mm. The distance between the centers of two adjacent teeth may be, for example, between 0.05 mm and 37.1 mm, preferably 0.5 mm and 4.0 mm. While twenty-four teeth may be disclosed, any number of teeth may also be feasible. The incorporated lubricating element 106 may be an extruded continuous strip or injected and/or 3D printed individual items and may be semi-circular in shape. According to further aspects, the incorporated lubricating element 106 may also be rectangular or any suitable shape. The incorporated lubricating element 106 may be attached adjacent the teeth 105*c* of the comb structure 105 adjacent to the upper surface 105*a* of the comb structure 105. Hence, the incorporated lubricating element 106 may be positioned below the blade 104 in front to the front end 102*c* of the blade support 102. The incorporated lubricating element 106 may be positioned so as not to project beyond the cutting edge 104*c*' of the blade 104. The incorporated lubricating element 106 may be have a height A, for example, of between 0.12 mm and 0.32 and a width B, for example, of between 0.1 mm and 0.3 mm, preferably 0.17 mm and 0.3 mm.

Figure 12A:
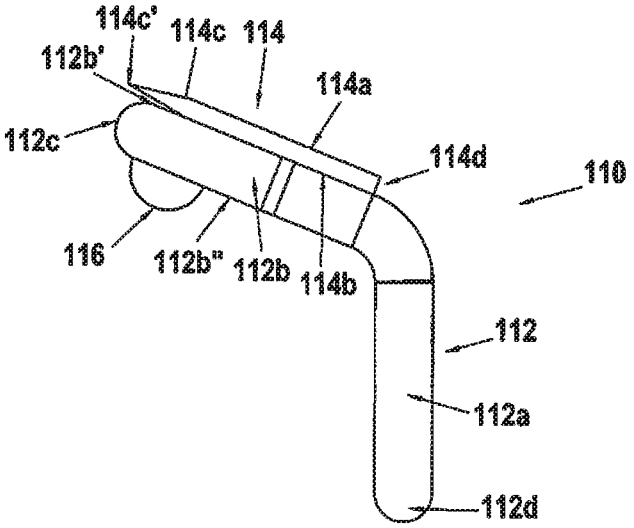
FIG. 12A details a cross-sectional view of another aspect of the incorporated lubricating element.
Figure 12B:
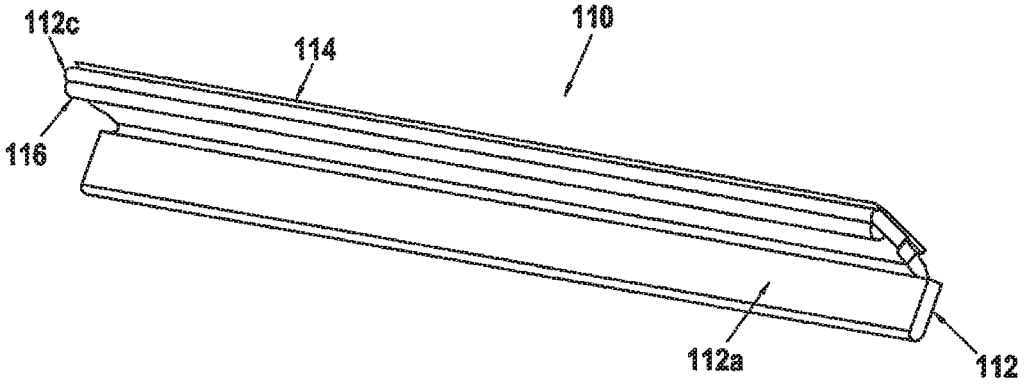
FIG. 12B details a perspective view of the incorporated lubricating element of FIG. 12A.

According to other aspects, as shown in FIGS. 12A and 12B, a blade assembly 110 may include a blade support 112, a blade 114 and an incorporated lubricating element 116. The blade 114 may include an upper surface 114*a*, a lower surface 114*b* opposite the upper surface 114*a*, and a cutting edge portion 114*c* extending from a cutting edge 114*c*' to an opposing end 114*d* opposite the cutting edge 114*c*'. The blade support 112 may include a base portion 112*a* and a flat portion 112*b*. The base portion 112*a* and the flat portion 112*b* may be built together to form a blade support 112. The cutting edge portion 114*c* may be mounted on the flat portion 112*b* of the blade support 112. The flat portion 112*b* may extend at an angle with the base portion 112*a*, such as for example, of between 104° to 120°. The base portion 112*a* may have a distal end 112*d* and the flat portion 112*b* may have a front end 112*c*. According to some aspects, the distal end 112*d* and front end 112*c* may be round or flat. The flat portion 112*b* may have an upper (outer) surface 112*b*' and a lower (inner) surface 112*b*" opposite the upper (outer) surface 112*b*'. The lower surface 114*b* of the blade 114 may be attached to the outer surface 112*b*' of the blade support 112. The front end 112*c* of the flat portion 112*b* of the blade support 112 may project beyond the cutting edge 114*c*' of the blade 114. The incorporated lubricating element 116 may be disposed on the lower (inner) surface 112*b*" of the flat portion 112*b* of the blade support 112 closest to the front end 112*c*. The incorporated lubricating element 116 may be an extruded continuous strip or injected and/or 3D printed individual items and may be semi-circular in shape. According to further aspects, the incorporated lubricating element 116 may also be rectangular or any suitable shape. The incorporated lubricating strip 116 may be have a height A, for example, of between 0.01 mm and 0.5 mm, preferably 0.1 mm and 0.5 mm and a width B, for example, of between 0.02 mm and 1.0 mm, preferably 0.2 mm and 1.0 mm.

According to further aspects, the incorporated lubricating elements 16, 26, 36, 46, 56, 66, 76, 86, 96, 106 and 116 may be made, as mentioned above, by following an extrusion, micro-extrusion or micro-injection or 3D printing process, more preferably 3D printing material extrusion and/or other 3D manufacturing techniques. The incorporated lubricating elements 16, 26, 36, 46, 56, 66, 76, 86, 96, 106 and 116 may be affixed on the blade assembly 10, 20, 30, 40, 50, 60, 70, 80, 90, 100 and 110, such as for example, by adhesion with adhesive or hot melt type adhesive, polymer welding, press-fit, snap-fit, hot embossing, insert molding, 3D printing methods, or any similar method.

The incorporated lubricating elements 16, 26, 36, 46, 56, 66, 76, 86, 96, 106 and 116 may include a lubrication compound. The lubrication compound may be made by a process that mixes water soluble (lubricating active) materials and water insoluble (non-lubricating active) materials without or with the incorporation of plasticizers, such as low molecular weight polyethylene glycols, water-swellable release enhancing agents, such as cross-linked polyacrylics and/or maleic anhydride compounds, additional lubricants, compatibilizers, surfactants, vitamins, botanical extracts, salts, humectants, fragrances, essential oils, silicon oils, organic oils, waxes, antioxidants, exfoliants, depilatory agents, surfactants, hair and skin conditioning agents, anti-bacterial agents, anti-microbial, anti-irritants, antiseptics, biocides, preservatives, skin cooling and soothing agents, moisturizing and hydrating agents, skin protectants, colorants, film formers, processing thickening agents from the list of silica, fume silica, $TiO_2$ particles, and combinations thereof.

According to aspects where the incorporated lubricating elements 16, 26, 36, 46, 56, 66, 76, 86, 96, 106 and 116 may be extruded, the melt may be pushed through a die, of a particular cross-section, and then may be undergone a cooling process to be cooled thereby forming the incorporated lubricating elements 16, 26, 36, 46, 56, 66, 76, 86, 96, 106 and 116. The die may have the desired cross-section, such as for example, a semi-circular shape having a rectangular portion, as shown in FIGS. 1A & 1B.

According to aspects where the incorporated lubricating elements 16, 26, 36, 46, 56, 66, 76, 86, 96, 106 and 116 may be injected and/or micro-injected, the melt compound may be injected directly into the cavity of a desired mold and the formed incorporated lubricating elements 16, 26, 36, 46, 56, 66, 76, 86, 96, 106 and 116 may be removed from the mold after being cooled.

According to aspects where the incorporated lubricating elements 16, 26, 36, 46, 56, 66, 76, 86, 96, 106 and 116 may be 3D printed by material extrusion and/or other 3D manufacturing techniques, the melt compound may be directly formed in a collecting base and the formed incorporated lubricating elements 16, 26, 36, 46, 56, 66, 76, 86, 96, 106 and 116 may be removed from the collecting base, or 3D printed directly on at least one bent blade of an assembly razor.

Figure 13B:
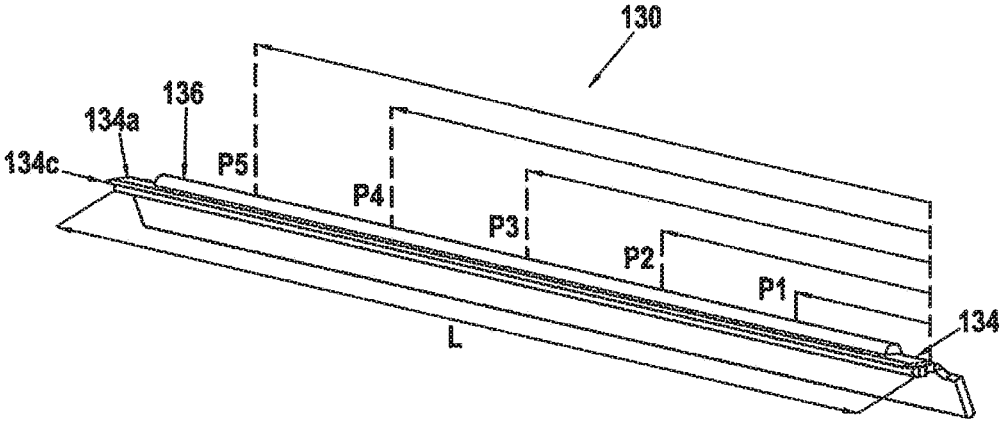
Figure 13C:
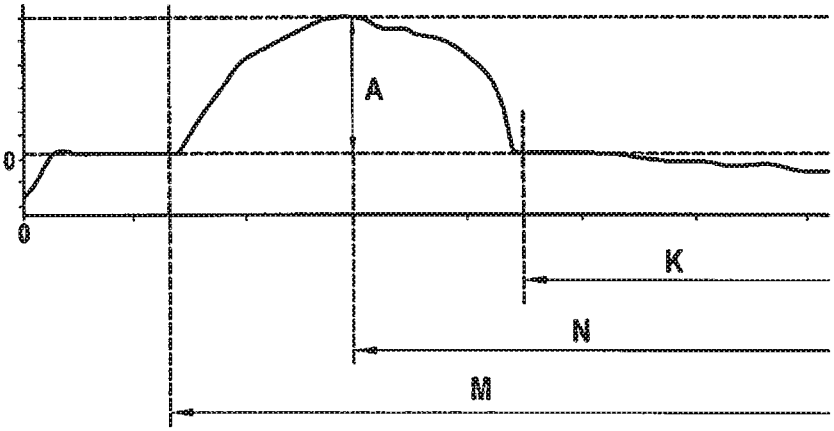

According to aspects and as shown in FIGS. 13A-13C, various potential locations that an incorporated lubricating element 136 may be positioned with respect to a blade 134 and a blade support 132 of the blade assembly 130 may be detailed. The blade assembly 130 may be an equivalent, yet exemplary aspect of the blade assembly 10 of FIGS. 1A and 1B. According to general aspects, the incorporated lubricating element 136 may be positioned at various locations within a triangular area defined, for example, by points EFG. Line $E_X$ may represent an imaginary extension of a surface corresponding to an outer surface 132*b*' of a flat portion 132*b* of the blade support 132 or to a lower surface 134*b* of the blade 134. Line $F_X$ may represent an imaginary extension of a surface corresponding to an outer surface 132*a*' of a base portion 132*a* of the blade support 132. The line $H_X$ may represent an imaginary line that is tangent to the incorporated lubricating element 136 and that passes through a distal-most point of a cutting edge 134*c*' of the blade 134. The line $H_X$ may be tangent to the incorporated lubricating element 136 at point H. The point H at which the line $H_X$ may be tangent to the incorporated lubricating element 136 may define the height A of a first portion 136*a* of the incorporated lubricating element 136. Line $H_X$ may intersect line $E_X$ at point E and may intersect the line $F_X$ at point F. Line $G_X$ may be a line that is perpendicular to the line $E_X$ and that may intersect the line $F_X$ at point F and the line $E_X$ at point G. According to some aspects, the point G may extend at any point along the line $E_X$. For example, the point G may extend along the line $E_X$ such that the point G is located beyond the outer surface 132*a*' of the base portion 132*a* of the blade support. Hence, points EFG may always define the area of various potential locations for the incorporated lubricating element 136 with respect to the blade support 132.

According to further aspects, an angle φ may be defined at an intersection of lines $H_X$ and $E_X$. The angle φ may be defined by the following equation of ta φ=FG/EG. The angle φ may be, for example, between 0 and 55 degrees (°). According to FIG. 13B, the method of locating the incorporated lubricating element 136 with respect to the blade 134 of the blade assembly 130 may involve first measuring five predefined positions, P1, P2, P3, P4 and P5 along a length L of the blade 134. The predefined positions P1-P5 may be measured individually from a side edge of the blade 134, along the length L of the blade 134, and a distance N from the cutting edge 134*c*' which can be seen in FIGS. 13C-13E. Measurement of the predefined positions P1-P5 with respect to the blade length L and the distance N from the cutting edge 134*c*' may be done using a microscope, for example, such as a Hirox RH-2000 microscope. The distance N may assist with defining a center of the cross-sectional profile of the incorporated lubricating element 136. The distance N which may coincide with the center of the cross-sectional profile of the incorporated lubricating element 136 may be defined using the following equation: N=(M+K)/2, where distance M is the distance of the front side of the incorporated lubricating element 136 from the blade cutting edge 134*c*' and K is the distance of the back side of the incorporated lubricating element 136 from the blade cutting edge 134*c*', as shown in FIG. 13C which depicts a cross-section of a blade assembly as created by the HIROX RH-2000 digital microscope.

Figure 13D:
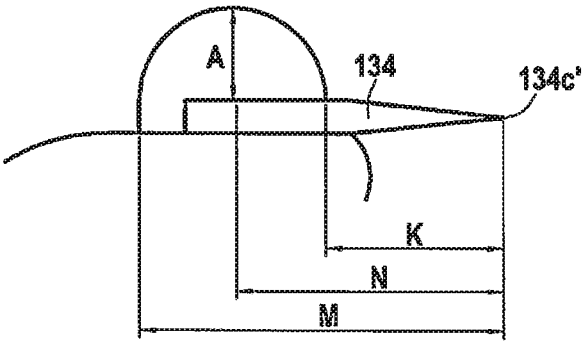
Figure 13E:
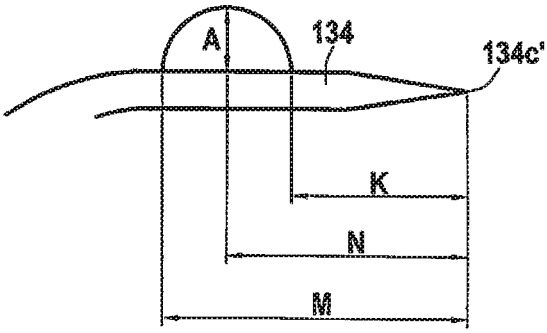

Once the incorporated lubricating element 136 has been positioned with respect to the blade cutting edge 134*c*' of the blade 134, the microscope may perform a scan of the blade assembly 130. At each individual predefined position P1-P5, the microscope may scan measurements such as, for example, the height A of the incorporated lubricating element and the distance N of the position of the incorporated lubricating element from the cutting edge 134*c*' of the blade. The measurements may be performed and collected on at least six consecutive samples of blade assemblies 130. The measurements performed and collected on the at least six samples may be used to calculate a mean value of the height A and distance N of the incorporated lubricating element for each blade assembly 130. The mean values may be used to calculate the mean value of the height A and position N of the incorporated lubricating element 136 that may be assigned to the next 200 samples of blade assemblies 130 that may be manufactured. This same measurement and assessment approach is used on assemblies having blades with a support and bent blades. For example, FIG. 13D depicts a cross-section of an ideal blade assembly comprising blades with a support having dimensions A, K, N, and M; whereas FIG. 13E depicts a cross-section of an ideal blade assembly comprising bent blades having dimensions of A, K, N, and M.

Figure 14A:
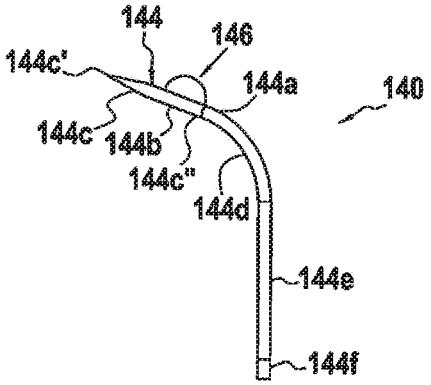
FIG. 14A details a cross-sectional view of an incorporated lubricating element on a bent blade.
Figure 14B:
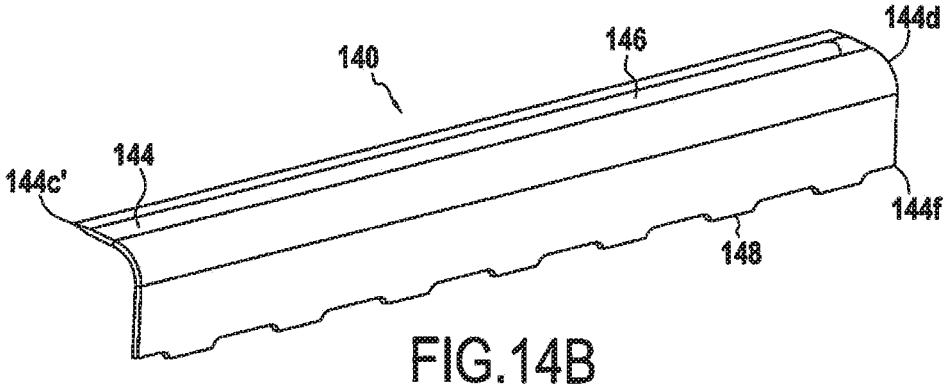
FIG. 14B details a perspective view of the blade and incorporated lubricating element of FIG. 14A.

An aspect of the disclosure, as shown in FIGS. 14A and 14B, may include a blade assembly 140 including a bent blade 144 and an incorporated lubricating element 146. The blade 144 may include an upper surface 144*a* and a lower surface 144*b* opposite the upper surface 144*a*. The blade 144 may further include a cutting edge portion 144*c* having a cutting edge 144*c*' and a flat portion 144*c*". In contrast to the previous embodiment, the flat portion 144*c*" may be part of the cutting edge portion 144*c*. The cutting edge portion 144*c* may share the upper surface 144*a* and the lower surface 144*b* of the blade 144. The blade 144 may further include a bent portion 144*d* adjacent to the cutting edge portion 144*c* and a base portion 144*e* that is adjacent to the bent portion 144*d*. In some examples, the cutting edge portion 144*c*, the base portion 144*e* and the flat portion 144*c*" may be integrally built as a monoblock to form a bent blade. The base portion 144*e* may have a distal end 144*f* which may be round or flat. The cutting edge portion 144*c* extends at an angle relative to the base portion 144*e*, said angle being defined by the bent portion. The angle between the base portion 144*e* and the cutting-edge portion 144*c* may be, for example, between 104° to 120°. The blade 144 may have a thickness between 0.04-0.12 mm.

The incorporated lubricating element 146 may be disposed on the upper surface 144*a* of the blade 144 between the cutting edge 144*c*' and bent portion 144*d*. In some examples, the incorporated lubricating element 146 may be positioned on at least one of the upper surface 144*a* and the lower surface 144*b* of the blade 144 (and/or the cutting edge portion 144*c*).

The incorporated lubricating element 146 may be made of water soluble and/or water insoluble polymers, and/or mixture of water soluble and water insoluble components. Examples of rigid water insoluble components are polystyrene, styrene co-polymers, polyethylene, polypropylene, polyacetal, acrylonitrile-butadiene-styrene copolymer, ethylene vinyl acetal copolymer, polylactic acid, polycarbonate, maleic anhydride ethylene co-polymer blends, polyether-containing block copolymers (e.g. with polyamide), blends and copolymers of the above with or without other additives. Examples of elastic water insoluble components are thermoplastic elastomer compounds (TPEs), more specifically thermoplastic poly-urethanes, and/or silicone polymers. Typical examples of water soluble lubricating components are polyethylene oxide and/or polyethylene glycol, polyvinyl pyrrolidone, polyacrylamide, polyhydroxymethacrylate, polyvinyl imidazoline, polyvinyl alcohol, polyhydromethymethacrylate, silicone polymers, blends and copolymers of the above. The incorporated lubricating element may be extruded or micro-extruded in a continuous strip line, and further processed to be assembled on the bent blade, or injected, or micro-injected, or 3D printed by material extrusion and/or other 3D manufacturing techniques in individual items to be further assembled on the bent blade. According to some aspects, the lubricating element may consist of 100%-10% of water insoluble component, and/or 90%-0% water soluble component, and/or 15%-0% other ingredients selected in the group of plasticizers, such as low molecular weight polyethylene glycols, water-swellable release enhancing agents, such as cross-linked polyacrylics and/or maleic anhydride compounds, additional lubricants, compatibilizers, surfactants, and/or skin care agent selected in the group consisting of vitamins, botanical extracts, salts, humectants, fragrances, essential oils, silicon oils, organic oils, waxes, antioxidants, exfoliants, depilatory agents, surfactants, hair and skin conditioning agents, anti-bacterial agents, anti-microbial, anti-irritants, antiseptics, biocides, preservatives, skin cooling and soothing agents, moisturizing and hydrating agents, skin protectants, colorants, film formers, processing thickening agents from the list of silica, fume silica, $TiO_2$ particles, and combinations thereof. The lubricating element 146 may have any suitable geometry. For example, in case where the lubricating element 146 has a semi-circular shape, the height A is between 0.01 mm and 0.5 mm, preferably 0.05 to 0.5 mm and its width B is between 0.02 to 1.0 mm, preferably 0.10 to 1.0 mm (See FIG. 2). As shown in the exemplary embodiment in FIGS. 14A and 14B, the lubricating strip forms a semi-circular portion having a height A of 0.23 mm and a width B of 0.46 mm. The lubricating element 146 may be extruded in a strip or injected in a strip form along at least a portion of the length of the blade.

Figure 15:
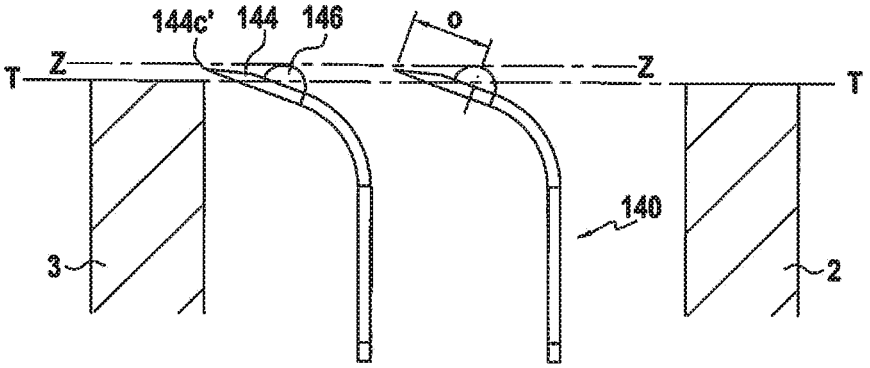
FIG. 15 details a cross-sectional view of an incorporated lubricating element on a bent blade in correlation with a shaving plane "Z".

In conventional wet shave devices, the head unit comprises a leading surface and a trailing surface that are generally at opposite sides. These leading and trailing surfaces can be used to define a shaving plane that is approximately tangent to these leading and trailing surfaces. The trailing surface may be defined by a cap and the leading surface may be defined by a guard. A skilled person is using this shaving plane as a reference for measuring the exposure of a cutting edge. According to some embodiments, the head unit comprises at least two bent blades and at least two lubricating elements attached to the cutting-edge portions of the bent blades. As shown in FIG. 15, the centroid of the lubricating element 146 may be offset by a distance "0" of 0.3 mm to 1.2 mm, preferably 0.65 mm to 0.83 mm from the cutting edge 144*c*' of the cutting portion 144*c*, while the length thereof may be disposed substantially parallel to the cutting edge 144*c*' of the cutting portion 144*c*.

A first shaving plane "T" may be defined by a tangent line intersecting said leading and trailing surfaces. A second shaving plane "Z" may be defined as a tangential line intersecting the tips of the one or more lubricating elements 146. According to the present disclosure, the cutting edge 144*c*' of the at least one or more blade elements 144 may have negative exposure relatively to the shaving plane "Z" while at the same time the exposure relatively to shaving plane "T" is positive, when the head unit is at rest position. However, after multiple uses of the wet shave device and due to, for example, the progressive wear off of the at least one or more lubricating elements 146, the shaving plane "Z" is adjusted towards the cutting edge 144*c*', thus resulting in a progressive change of exposure of the cutting edge 144*c*' relatively to the shaving plane "Z" to ultimately become neutral or positive relatively to said plane "Z". One may understand that using lubricating elements 146 directly on the surface of a blade enables a user to benefit from an artificial negative exposure (versus plane "Z") and then have the cutting edge more and more exposed as the lubricating element wears off to ultimately have a head unit with a positive exposure relatively to "Z". This will enable an improved shaving performance along the life of the cartridge since comfort will be optimized due to the negative exposure while maintaining closeness even after several shaves since the absolute positive exposure versus "T" will be revealed through the wear off of the lubricating element. The term "exposure" as used herein is intended to mean the perpendicular distance of a cutting edge 144*c*' from the plane "Z" or from the plane "T" accordingly. Negative exposure has been found to provide various benefits to the user; durability of the blades is extended since the shaving becomes less aggressive. Further, the overall shaving experience is improved since the contact between the skin and the blades is smooth, thus resulting in less nicks and cuts.

Figure 16A:
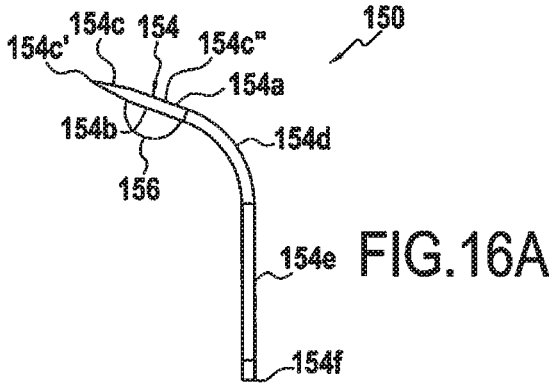
FIG. 16A details a cross-sectional view of another aspect of the incorporated lubricating element.
Figure 16B:
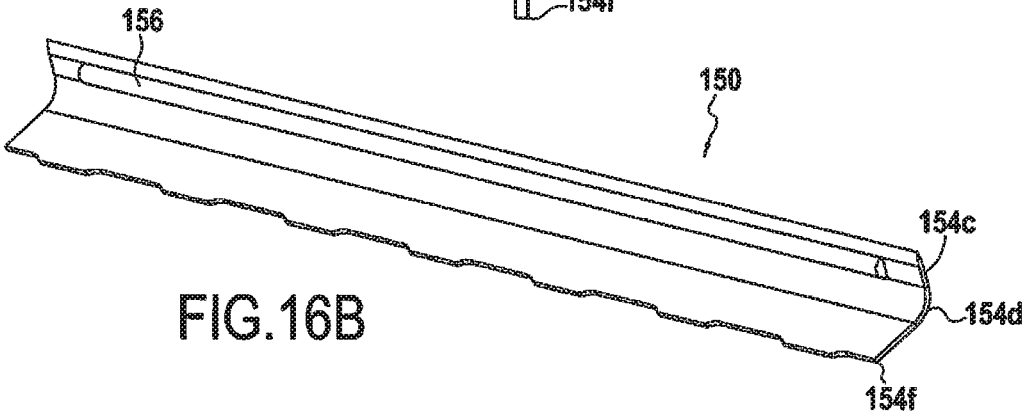
FIG. 16B details a perspective view of the incorporated lubricating element of FIG. 16A.

According to further aspects, as shown in FIGS. 16A and 16B, a blade assembly 150 may include a blade 154 and an incorporated lubricating element 156. The blade 154 may include an upper surface 154*a*, a lower surface 154*b* opposite the upper surface 154*a*. The blade 154 may also include a cutting portion 154*c* having a cutting edge 154*c*' a flat portion 154*c*", a base portion 154*e*, and a bent portion 154*d* disposed therebetween. The base portion 154*e* may have a distal end 154*f* which may be round or flat. The cutting portion 154*c* may extend at an angle relative to the base portion 154*e*, for example, between 104° to 120°.

The incorporated lubricating element 156 may be disposed on the lower surface 154*b* of the cutting portion 154 between the cutting edge 154*c*' and the bent portion 154*d*. The incorporated lubricating element 156 may be an extruded continuous strip or injected or 3D printed individual items and may be semi-circular in shape as seen in cross section perpendicular to the length of the cutting edge. According to further aspects, the incorporated lubricating element 156 may also be rectangular or any other suitable shape. For example, in a case where the lubricating element 146 has a semi-circular shape, the height A is between 0.01 mm to 0.5 mm, preferably 0.1 mm to 0.5 mm and its width B is between 0.02 mm to 1.0 mm, preferably 0.2 to 1.0 mm (See FIG. 2). The lubricating strip has a semi-circular cross-section and is attached under the bent blade, meaning in the lower, inner flat surface.

Figure 17A:
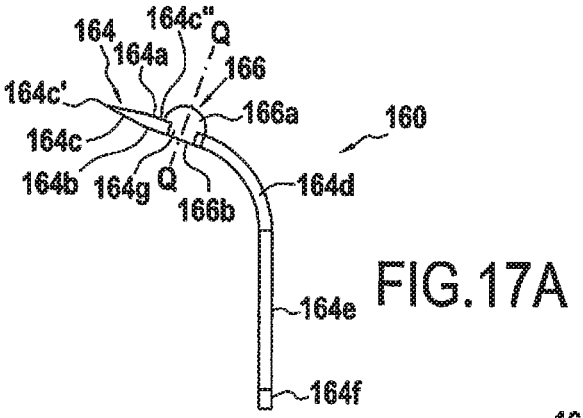
FIG. 17A details a cross-sectional view of another aspect of the incorporated lubricating element.
Figure 17B:
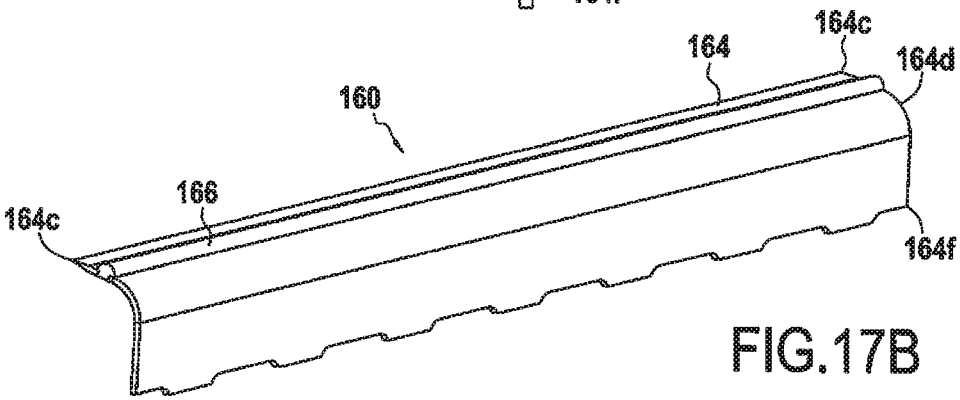
FIG. 17B details a perspective view of the incorporated lubricating element of FIG. 17A.

According to further aspects, as shown in FIGS. 17A and 17B, a blade assembly 160 may include a blade 164 and an incorporated lubricating element 166. The blade 164 may include an upper surface 164*a* and a lower surface 164*b* opposite the upper surface 164*a*. The blade 164 may also include a cutting edge portion 164*c* having a cutting edge 164*c*' and a flat portion 164*c*", a base portion 164*f*, and an intermediate portion 164*d* disposed therebetween. The cutting edge portion 164*c* may form at least one aperture 164*g*. Although in the embodiment depicted in FIGS. 17A and 17B shows one aperture, the cutting edge portion 164*c* may form a plurality of apertures 164*g* that may be spaced equidistantly there along. The base portion 164*e* of the blade 164 may have a distal end 164*f* that may be round or flat. The cutting edge portion 164*c* may extend at an angle relative to the base portion 164*e*, for example, between 104° to 120°.

The incorporated lubricating element 166 may include a first portion 166*a* and a second portion 166*b*. The first portion 166*a* may have various shapes, more preferably a semi-circular shape, and the second portion 166*b* may have various shapes, more preferably a rectangular shape, both in cross-section, transverse to the length of the cutting edge. The first portion 166*a* and the second portion 166*b*, together, may form a mushroom-shape cross-section. For example, the first portion 166*a* and the second portion 166*b* may have a center axis "Q", where the maximum radial distance of the first portion 166*a* relative to the center axis Q can be larger or smaller than the maximum radial distance of the second portion 166*b*. While the first portion 166*a* may be detailed as being semi-circular shaped, according to further aspects, the first portion 166*a* may also be a rectangular shape. According to other aspects, the first portion 166*a* may be rectangular or any other suitable shape. The second portion 166*b* of the incorporated lubricating element 166 may extend through the apertures 164*g* formed in the blade 164 (and/or the cutting edge portion 164*c*) such that the second portion 166*b* may be disposed in at least one aperture 164*g* of the blade 164 (and/or the cutting edge portion 164*c*) and the first portion 166*a* may be disposed on the upper surface 164*a* of the blade 164 (and/or the cutting edge portion 164*c*). The incorporated lubricating element 166 may comprise the second portion 166*b* as attachment portion, which engages with the at least one aperture 164*g*. In some examples, the incorporated lubricating element 166 may comprise a lubricating strip portion and a plurality of attachment portions, where the attachment portions project from a surface of the lubricating strip portion thereby engaging with the plurality of apertures 164*g*.

The incorporated lubricating element 166 may be an extruded continuous strip or injected and/or 3D printed individual items. The first portion 166*a* of the incorporated lubricating element 166 may have a height A, for example, between 0.01 mm and 0.5 mm, preferably 0.17 mm and 0.5 mm and a width B, for example, between 0.01 mm and 1.0 mm. The second portion 166*b* of the incorporated lubricating element 166 may be have a width "C" and a height "D", for example, between 0.01 mm and 3.0 mm, preferably 0.1 and 1.0 mm, and 0.04 mm and 0.12 mm, preferably 0.05 mm and 0.1 mm, respectively. The second portion 166*b* may be centered on the width B of the first portion 166*a*. According to some aspects, the first portion 166*a* and the second portion 166*b* may be formed separately, as individual pieces, wherein the second portion 166*b* may be attached to the first portion 166*a*, for example, by adhesion and/or any other similar technique.

Figure 18A:
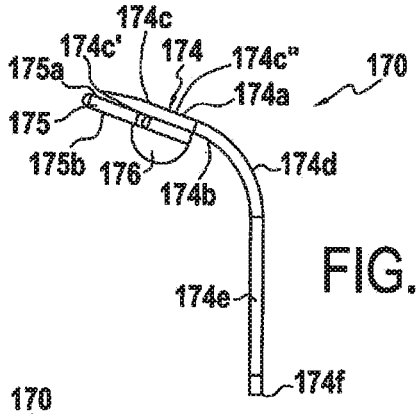
FIG. 18A details a cross-sectional view of another aspect of the incorporated lubricating element.
Figure 18B:
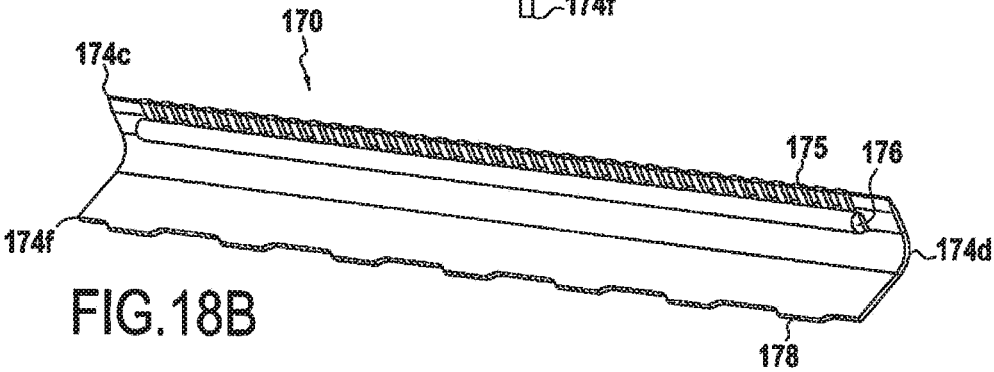
FIG. 18B details a perspective view of the incorporated lubricating element of FIG. 18A.

According to further aspects, as shown in FIGS. 18A and 18B, a blade assembly 170 may include a blade 174, a comb structure 175, and an incorporated lubricating element 176. The blade 174 may include an upper surface 174*a* as outer surface and a lower surface 174*b* opposite the upper surface 174*a* as inner surface. The blade 174 may also include a cutting edge portion 174*c* having a cutting edge 174*c*' and a flat portion 174*c*", a base portion 174*e* and a bent portion 174*d* therebetween. The cutting edge portion 174*c* may extend at an angle relative to the base portion 174*e*, for example, of between 104° to 120°. The base portion 174*e* may have a distal end 174*f*. According to some aspects, the distal end 174*f* may be round or flat.

The comb structure 175 may have an upper surface 175*a* and a lower surface 175*b* opposite the upper surface 175*a*. The comb structure 175 may include teeth 175*c*. According to further aspects, the teeth 175*c* may be round, rectangular, or any suitable shape. The teeth 175*c* may project a distance beyond the cutting edge of the cutting edge portion 174*c*. For example, the distance that the teeth 175*c* may project beyond the cutting edge 174*c*' between 0.05 mm and 1.0 mm, preferably 0.1 mm to 0.5 mm. The distance between two adjacent teeth 175*c* may be between 0.05 mm and 37.1 mm, preferably 0.5 mm and 4.0 mm. Although a set number of teeth are depicted in the exemplary figures, any number of teeth may be used. The upper surface 175*a* of the comb structure 175 may be attached to the lower surface 174*b* of the blade 174. Further, the incorporated lubricating element 176 may be disposed on the lower surface 175*b* of the comb structure 175. In some examples, the comb structure may be attached to a lower surface of the incorporated lubricating element 176 and the lower surface 174*b* of the blade 174 and/or of the flat portion 174*c*", such that the comb structure supports the incorporated lubricating element 176.

The incorporated lubricating element 176 may be a continuous extruded strip or injected and/or 3D printed individual items and may be semi-circular in shape. According to further aspects, the incorporated lubricating element 176 may also be rectangular or any suitable shape. The incorporated lubricating element 176 may have a height A, for example, between 0.01 mm and 0.5 mm, preferably 0.1 mm and 0.3 mm and a width B, for example, between 0.02 mm to 1.0 mm, preferably 0.2 mm to 0.8 mm. Further, the lubricating element 176 may be attached to the comb structure 175, for example, by adhesion and/or any other similar technique.

Figure 19A:
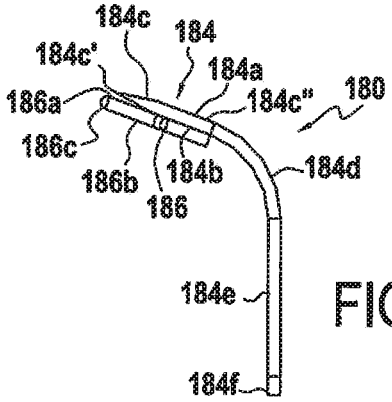
FIG. 19A details a cross-sectional view of another aspect of the incorporated lubricating element.
Figure 19B:
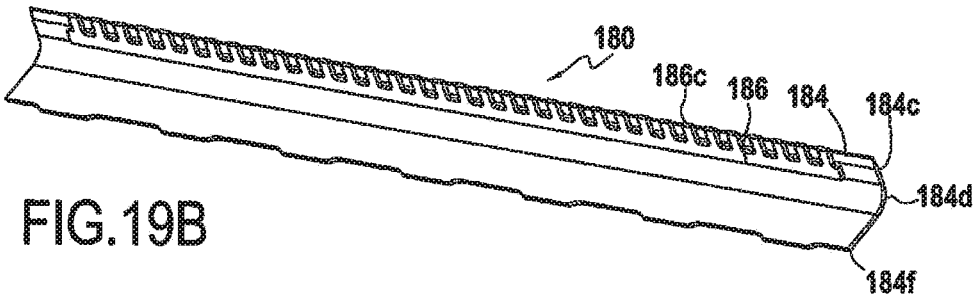
FIG. 19B details a perspective view of the incorporated lubricating element of FIG. 19A.

According to further aspects, as shown in FIGS. 19A and 19B, a blade assembly 180 may include a blade 184 and an incorporated lubricating element 186. The blade 184 may include an upper surface 184*a* and a lower surface 184*b* opposite the upper surface 184*a*. The blade 184 may also include a cutting edge portion 184*c* having a cutting edge 184*c*', a base portion 184*e*, and a bent portion 184*d* therebetween. The base portion 184*e* may have a distal end 184*f*, where the distal end 184*f* may be round or flat. The cutting edge portion 184 may extend at an angle relative to the base portion 184*e*, for example, between 104° to 120°.

The incorporated lubricating element 186 may form a comb. It is envisioned that the any portion of the comb can be made of lubricating material, for example, only the teeth, or only the base, or the entire comb, or any suitable configuration. In other words, in this example, at least part of the comb structure is made of lubricating material. The incorporated lubricating element 186 may include an upper surface 186*a* and a lower surface 186*b* opposite the upper surface 186*a*, as well as teeth 186*c*. According to further aspects, the teeth 186*c* may be round, rectangular, or any suitable shape. The incorporated lubricating element 186 may be extruded or injected. The upper surface 186*a* of the incorporated lubricating element 186 may be disposed on the lower surface 184*b* of the blade 184. The incorporated lubricating element 186 may be positioned such that the teeth 186*c* may project parallel to and offset from the cutting edge 184*c*' by a distance. The distance that the teeth 186*c* may project beyond the cutting edge may be, for example, between 0.05 mm to 1.0 mm, preferably 0.1 mm to 0.5 mm. The teeth 186*c* may be spaced equidistantly along the incorporated lubricating element 186. A distance between the centers of two adjacent teeth 186*c* may be, for example, between 0.05 mm and 37.1 mm, preferably 0.5 mm and 4.0 mm. Although a set number of teeth are depicted in the exemplary embodiments shown, any number of teeth may also be used. The incorporated lubricating element 186 may have a height A, for example, of between 0.05 mm and 1.0 mm, preferably 0.2 mm and 0.3 mm and a width B, for example, between 0.5 mm and 3.0 mm, preferably 1.3 mm and 1.85 mm.

Figure 20A:
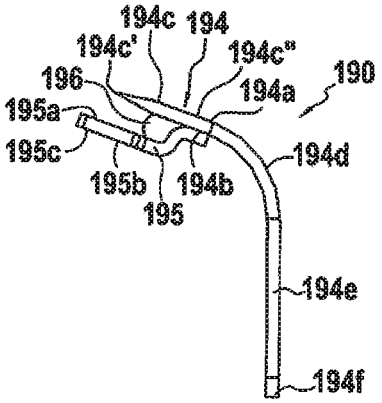
FIG. 20A details a cross-sectional view of another aspect of the incorporated lubricating element.
Figure 20B:
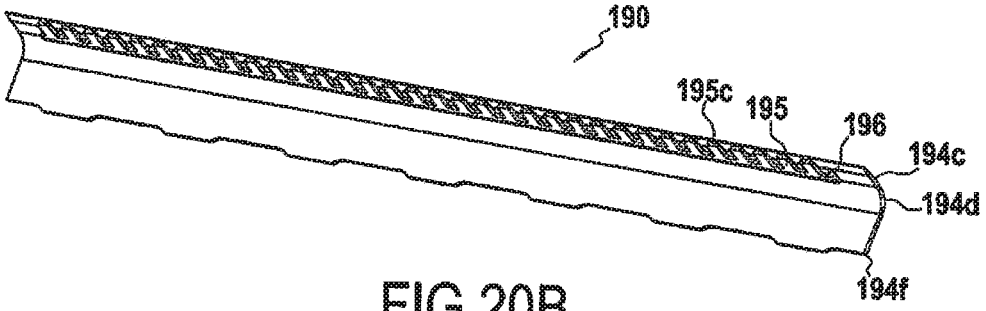
FIG. 20B details a perspective view of the incorporated lubricating element of FIG. 20A.

According to further aspects, as shown in FIGS. 20A and 20B, a blade assembly 190 may include a blade 194, a comb structure 195, and an incorporated lubricating element 196. The blade 194 may include an upper surface 194*a* as outer surface and a lower surface 194*b* as inner surface opposite the upper surface 194*a*. The blade 194 may also include a cutting-edge portion 194*c* having a cutting edge 194*c*' and a flat portion 194*c*", a base portion 194*e*, and a bent portion 194*d* therebetween. Thus, the flat portion 194*c*" may share the upper surface 194*a* (as outer surface) and the lower surface 194*b* (as inner surface) of the blade 194. The cutting edge portion 194*c* may extend at an angle relative to the base portion 194*e*, for example, between 104° to 120°. The base portion 194*e* may have a distal end 194*f*, where the distal end 194*f* may be round or flat.

The comb structure 195 may have an upper surface 195*a* and a lower surface 195*b* opposite the upper surface 195*a*. The lower surface 194*b* of the blade 194 may be attached to the upper surface 195*a* of the comb structure 195. The comb structure 195 may include teeth 195*c*. According to further aspects, the teeth 195*c* may also be round, rectangular, or any suitable shape. The comb structure 195 may be positioned with respect to the cutting edge of the cutting edge portion 194*c* such that the teeth 195*c* of the comb structure 195 may be substantially parallel to and offset from and the cutting edge 194*c*' by a distance. The distance that the teeth 195*c* may project beyond the cutting edge 194*c*' may be, for example, between 0.05 mm to 1.0 mm, preferably 0.1 mm to 0.5 mm.

The distance between the centers of two adjacent teeth may be, for example, between 0.05 mm and 37.1 mm, preferably 0.5 mm and 4.0 mm. Although a set number of teeth are depicted in the exemplary embodiments, any number of teeth may also be used. The incorporated lubricating element 196 may be a continuous extruded strip or injected and/or 3D printed individual items and may be semi-circular in shape. According to further aspects, the incorporated lubricating element 196 may also be rectangular or any other suitable shape.

The incorporated lubricating element 196 may be arranged in a recess formed between the comb structure and the cutting edge portion of the blade 194. In the example shown, the comb structure 195 is attached to the lower surface 194*b* of the cutting edge portion 194*c* of the blade 194, and the recess is formed between the upper surface 195*a* of the comb structure and the lower surface of the cutting portion 194*b*. Thus, in this example, the incorporated lubricating element 196 is within the recess, attached to the upper surface of the comb structure 195*a* and attached to the lower surface of the blade 194*b* such that the incorporated lubricating element 196 is supported by the upper surface of the comb structure 195*a*. The incorporated lubricating element 196 may have a height A, for example, of between 0.05 mm and 0.5 mm, preferably 0.12 mm and 0.32 and a width B, for example, between 0.05 mm and 1.0 mm, preferably 0.17 mm and 0.3 mm. Hence, the incorporated lubricating element 106 may be positioned so as to not project beyond the cutting edge 194*c*' of the blade 194.

The various arrangements for the incorporated lubricating element described above are compatible. In particular, in the blade assembly, provision may be made for all the blades of the blade assembly to incorporate a lubricating element, or for some of the blades only to incorporate a lubricating element. Also, in case the blade assembly includes a plurality of blades, provision may be made for all the incorporated lubricating elements of the respective blades to be identical or similar, whereas it is also possible for the blades to present different incorporated lubricating element. For example, one or several blades may present incorporated lubricating elements formed of discrete, lubricating spots arranged in at least one row along the longitudinal direction of their respective cutting edge portions, whereas one or several other blades may present incorporated lubricating element formed by lubricated strips. Also, a blade may present both lubricating spots, arranged in one row, and a lubricating strip parallel to said row, for example.

As is evident from the figures and text presented above, as well as the examples below, a variety of embodiments are contemplated:

1. A blade assembly comprising:
   a blade support including a flat portion and a base, the flat portion extending at an angle with respect to the base;
   a blade attached to the flat portion of the blade support; and
   an incorporated lubricating element, the incorporated lubricating element being attached to at least the blade.
2. The blade assembly of embodiment 1, wherein the incorporated lubricating element including a first portion and a second portion.
3. The blade assembly of embodiment 2, wherein the first portion being adjacent to the blade and the second portion being adjacent to the blade support.
4. The blade assembly of embodiment 3, wherein the first portion is semi-circular shaped and the second portion is rectangular shaped.
5. The blade assembly of embodiment 4, wherein the first portion and the second portion are formed as a single piece.
6. The blade assembly of embodiment 1, wherein the incorporated lubricating element is made from an active material.
7. The blade assembly of embodiment 1, wherein the incorporated lubricating element is made from an inactive material.
8. The blade assembly of embodiment 1, wherein the incorporated lubricating element is made from combination of active and inactive materials.
9. The blade assembly of embodiment 5, wherein the first portion is a mushroom-shaped head and the second portion is a stem extending from the mushroom-shaped head.
10. The blade assembly of embodiment 9, wherein the blade includes apertures and the second portion extends through the apertures and are attached to the blade support.
11. The blade assembly of embodiment 10, wherein the first portion is attached to the blade.
12. The blade assembly of embodiment 1, wherein the blade further includes an upper surface and a lower surface, and the blade support further includes a front end, the incorporated lubricating element being attached to the lower surface of the blade and the front end of the flat portion.

13. The blade assembly of embodiment 12, wherein the incorporated lubricating element is quarter-circular shaped.
14. The blade assembly of embodiment 12, wherein further including a comb structure, the comb structure being attached to the lower surface of the incorporated lubricating element and the lower surface of the flat portion of the blade support.
15. The blade assembly of embodiment 1, wherein the blade further includes a cutting edge and an end opposite the cutting edge, the blade support further includes an upper surface and a lower surface, the incorporated lubricating element being attached to the end of the blade opposite the cutting edge and to the upper surface of the flat portion of the blade support.
16. A blade assembly comprising: at least one bent blade including a cutting edge portion, a base portion and a bent portion intermediate to the cutting edge portion and the base portion, the bent portion being formed integrally with at least the cutting edge portion, and an incorporated lubricating element, the incorporated lubricating element being attached to the cutting edge portion of the bent blade.
17. The blade assembly of embodiment 16, comprising a plurality of bent blades, each bent blade including a cutting edge portion, a base portion and a bent portion intermediate to the cutting edge portion and the base portion, the bent portion being formed integrally with at least the cutting edge portion, at least one of said bent blades being a bent blade with an incorporated lubricating element being attached to the cutting edge portion of the bent blade.
18. The blade assembly of embodiment 16 or 17, wherein each bent blade of the plurality of bent blades is lubricated.
19. The blade assembly of any one of embodiments 16 to 18, wherein the cutting edge portion, the bent portion and the base portion are integrally formed.
20. The blade assembly of any one of embodiments 16 to 19, wherein the incorporated lubricating element of the at least one bent blade is positioned on at least one of an upper surface and a lower surface of the cutting edge portion of the bent blade.
21. The blade assembly of any one of embodiments 16 to 20, comprising a comb structure, attached to the cutting edge portion of the at least one bent blade and supporting the incorporated lubricating element of said bent blade.
22. The blade assembly of embodiment 21, wherein at least part of the comb structure is made of lubricating material.
23. The blade assembly of embodiment 21 or 22, wherein the comb structure has a first face attached to the at least one bent blade, and a second surface supporting the incorporated lubricating element.
24. The blade assembly of any one of embodiments 21 to 23, wherein the incorporated lubricating element is arranged in a recess formed between the comb structure and the cutting edge portion of the at least one bent blade.
25. The blade assembly of any one of embodiments 21 to 24, wherein the comb extends beyond the cutting edge of the cutting edge portion.
26. The blade assembly of any one of embodiments 16 to 26, wherein the at least one bent blade includes at least one aperture formed through the cutting edge portion and the incorporated lubricating element of said bent blade comprises an attachment portion, which engages said aperture.
27. The blade assembly of any one of embodiments 16 to 27, wherein the lubricating element of the at least one bent blade includes a plurality of lubricating spots arranged in at least one row, along a longitudinal direction of the cutting edge portion of said at least one bent blade.
28. The blade assembly of any one of embodiments 16 to 28, wherein the at least one bent blade includes a plurality of apertures formed through the cutting edge portion and the incorporated lubricating element of said bent blade comprises a lubricating strip portion and a plurality of attachment portions, which project from a surface of said lubricating strip portion and which engage said apertures.
29. The blade assembly of any one of embodiments 16 to 29, wherein at least one cross-section of the incorporated lubricating element of the at least one bent blade is mushroom-shaped.
30. A head unit comprising:
a leading surface and a trailing surface defining a first shaving plane approximately tangent to these leading and trailing surfaces,
at least two blades, including a cutting edge portion, a base portion and a bent portion intermediate to the cutting edge portion and the base portion, the bent portion being formed integrally with at least the cutting edge portion, and at least two incorporated lubricating elements on the at least two blades, the incorporated lubricating elements being attached to the cutting edge portions of the bent blades, wherein the tips of the at least two lubricating elements define a second shaving plane, characterized in that the exposure of the cutting edge portion is negative relative to the second shaving plane and positive relative to the first shaving plane or positive to both first and second shaving planes.
31. The blade assembly of any one of the preceding embodiments, wherein the cutting edge portion is angled between 104° to 120° relative to the base portion.

While aspects of the disclosure have been described in detail in the foregoing description, the same is to be considered as illustrative and not restrictive in character, it being understood that only some aspects have been shown and described and that all changes and modifications that come within the scope of the claims are to be protected. It is intended that combinations of the above-described elements and those within the specification may be made, except where otherwise contradictory. Although aspects of the disclosure have been described, it would be obvious to those skilled in the art that various other changes and modifications can be made without departing from the scope of the claims. It is therefore intended to cover in the appended claims all such changes and modifications that are within the scope of the disclosure.

The invention claimed is:

1. A blade assembly comprising:
at least one blade element including:
a cutting-edge portion,
a base portion, and
a flat portion intermediate to a cutting edge of the cutting-edge portion and the base portion,
the flat portion extending at an angle with respect to the base portion, wherein the blade assembly further comprises an incorporated lubricating element having an incorporated lubricating element first end and an incorporated lubricating element second end, the incorporated lubricating element being attached to the cutting-edge portion of the at least one blade element, wherein the cutting edge portion extends from the cutting edge to an end opposite the cutting edge, the flat portion of the blade element further including a flat upper surface and a lower surface, the flat upper surface extending in a plane, the incorporated lubricating element first end being in direct contact with an upper surface of the cutting-edge portion, and the incorporated lubricating element second end being in direct contact with the flat upper surface of the flat portion only within the plane, wherein the blade assembly further includes a curved bent portion disposed between the flat portion and the base portion, wherein the incorporated lubricating element does not directly contact the curved bent portion.

2. The blade assembly of claim 1, wherein the flat portion and the base portion are built together to form a blade support, the cutting-edge portion being mounted on the flat portion of the blade support.

3. The blade assembly of claim 2, wherein the incorporated lubricating element includes a first portion and a second portion.

4. The blade assembly of claim 3, wherein the first portion is adjacent to the cutting-edge portion and the second portion is adjacent to the blade support.

5. The blade assembly of claim 3, wherein the first portion is semi-circular and the second portion is rectangular shaped.

6. A head unit comprising:

a leading surface and a trailing surface defining a first shaving plane approximately tangent to these leading and trailing surfaces, at least two blade assemblies according to claim 1, wherein tips of the at least two lubricating elements define a second shaving plane, wherein an exposure of the cutting edge of at least one of the cutting edge portions is negative relative to the second shaving plane and positive relative to the first shaving plane or positive relative to both the first and second shaving planes.

7. The blade assembly of claim 1, further comprising a second blade element comprising a second incorporated lubricating element, wherein one or more of the incorporated lubricating element and the second incorporated lubricating element comprises a water soluble component.

8. The blade assembly of claim 1, wherein an entirety of the incorporated lubricating element is spaced apart from the curved bent portion.

9. The blade assembly of claim 1, wherein the incorporated lubricating element extends continuously and uninterrupted along the surfaces of either the cutting-edge portion or the flat portion.

10. A blade assembly comprising:

at least one blade element including:

a cutting-edge portion, a base portion, and a flat portion intermediate to a cutting edge of the cutting-edge portion and the base portion, the flat portion extending, in only one direction from the base portion, at an angle with respect to the base portion, wherein the blade assembly further comprises an incorporated lubricating element, the incorporated lubricating element being attached to the cutting-edge portion of the at least one blade element, wherein the cutting edge portion extends from the cutting edge to an end opposite the cutting edge, the flat portion further including an upper surface and a lower surface, wherein the incorporated lubricating element is in direct contact with both of the cutting-edge portion and the flat portion, wherein the incorporated lubricating element extends continuously and uninterrupted along the surfaces of either the cutting-edge portion or the flat portion, wherein the blade assembly further includes a curved bent portion disposed between the flat portion and the base portion, wherein the incorporated lubricating element does not directly contact the curved bent portion.

11. The blade assembly of claim 10, wherein the incorporated lubricating element comprises a water soluble component.

* * * * *